US010662732B2

(12) United States Patent
Frazier

(10) Patent No.: US 10,662,732 B2
(45) Date of Patent: May 26, 2020

(54) SPLIT RING SEALING ASSEMBLIES

(71) Applicant: MAGNUM OIL TOOLS INTERNATIONAL, LTD., Corpus Christi, TX (US)

(72) Inventor: W. Lynn Frazier, Corpus Christi, TX (US)

(73) Assignee: Magnum Oil Tools International, Ltd., Corpus Christi, TX (US)

( * ) Notice: Subject to any disclaimer, the term of this patent is extended or adjusted under 35 U.S.C. 154(b) by 303 days.

(21) Appl. No.: 15/672,790

(22) Filed: Aug. 9, 2017

(65) Prior Publication Data

US 2017/0370176 A1 Dec. 28, 2017

Related U.S. Application Data

(63) Continuation-in-part of application No. 15/403,739, filed on Jan. 11, 2017, now Pat. No. 10,337,279, which is a continuation-in-part of application No. 15/189,090, filed on Jun. 22, 2016, now Pat. No. 10,352,125, which is a continuation-in-part of application No. 14/677,242, filed on Apr. 2, 2015, now Pat. No. 10,119,359.

(60) Provisional application No. 62/406,195, filed on Oct. 10, 2016, provisional application No. 62/374,454, filed on Aug. 12, 2016, provisional application No. 62/372,550, filed on Aug. 9, 2016, provisional application No. 62/019,679, filed on Jul. 1, 2014, provisional application No. 62/003,616, filed on May 28, 2014, provisional application No. 61/974,065, filed on Apr. 2, 2014.

(51) Int. Cl.

| | |
|---|---|
| ***E21B 33/12*** | (2006.01) |
| ***E21B 33/128*** | (2006.01) |
| ***E21B 33/129*** | (2006.01) |
| ***E21B 33/134*** | (2006.01) |
| ***E21B 43/26*** | (2006.01) |
| ***E21B 34/06*** | (2006.01) |

(52) U.S. Cl.

CPC ..... *E21B 33/1212* (2013.01); *E21B 33/128* (2013.01); *E21B 33/1291* (2013.01); *E21B 33/1293* (2013.01); *E21B 33/134* (2013.01); *E21B 34/063* (2013.01); *E21B 43/26* (2013.01)

(58) Field of Classification Search

CPC ..... E21B 33/1212; E21B 33/128; E21B 33/1291; E21B 33/1293; E21B 33/134; E21B 34/063; E21B 43/26

See application file for complete search history.

(56) References Cited

U.S. PATENT DOCUMENTS

| | | | | |
|---|---|---|---|---|
| 4,281,840 A * | 8/1981 | Harris | ..... | E21B 33/1208 277/342 |
| 4,441,721 A * | 4/1984 | Harris | ..... | E21B 33/1208 277/342 |
| 4,697,640 A * | 10/1987 | Szarka | ..... | E21B 33/1295 166/120 |
| 5,131,468 A | 7/1992 | Lane et al. | | |
| 5,984,007 A | 11/1999 | Yuan et al. | | |

(Continued)

*Primary Examiner* — Yong-Suk Ro

(74) *Attorney, Agent, or Firm* — Jackson Walker LLP

(57) ABSTRACT

A settable downhole tool with preset metallic split rings having gaps from their leading edges to their trailing edges. The rings expand radially outward during setting by widening the gaps, adjacent rings covering the gaps, creating a substantially fluid tight metal to metal seal with the casing.

48 Claims, 29 Drawing Sheets

(56) References Cited

U.S. PATENT DOCUMENTS

| | | | | |
|---|---|---|---|---|
| 7,900,696 | B1 | 3/2011 | Nish | |
| 8,579,024 | B2 | 11/2013 | Mailand et al. | |
| 8,887,818 | B1 | 11/2014 | Carr et al. | |
| 9,027,655 | B2 | 5/2015 | Xu et al. | |
| 9,181,781 | B2 | 11/2015 | Agrawal et al. | |
| 9,441,448 | B2 | 9/2016 | Frazier | |
| 2002/0014339 | A1 | 2/2002 | Ross | |
| 2005/0269074 | A1 | 12/2005 | Chitwood | |
| 2007/0074873 | A1* | 4/2007 | McKeachnie | E21B 33/1294 166/376 |
| 2011/0005779 | A1* | 1/2011 | Lembcke | E21B 33/1293 166/387 |
| 2013/0240200 | A1 | 9/2013 | Frazier | |
| 2014/0090831 | A1 | 4/2014 | Young et al. | |
| 2014/0116677 | A1* | 5/2014 | Sherlin | B29C 70/462 166/203 |
| 2015/0285026 | A1 | 10/2015 | Frazier | |
| 2016/0376869 | A1 | 12/2016 | Rochen et al. | |
| 2017/0101835 | A1 | 4/2017 | Webster et al. | |
| 2017/0218711 | A1 | 8/2017 | Kash | |
| 2017/0284167 | A1 | 10/2017 | Takahashi et al. | |

* cited by examiner

PRESET (REAR VIEW)

FIG. 4B1

(FRONT VIEW)

PRESET (THREE RING)

(POST SET) (4 RING)

(set position)
4-ring (PRESET)

(SET)

SPLIT RING SEALING ASSEMBLIES

This is a utility patent application which claims priority to and incorporates by reference U.S. Provisional Application Ser. No. 62/372,550, filed Aug. 9, 2016; Application Ser. No. 62/374,454, filed Aug. 12, 2016; and Application Ser. No. 62/406,195, filed Oct. 10, 2016. This application is a continuation-in-part of application Ser. No. 15/403,739, filed Jan. 11, 2017, which is a continuation-in-part and claims priority to application Ser. No. 15/189,090, filed Jun. 22, 2016, which is a continuation-in-part of, and claims priority to application Ser. No. 14/677,242, filed Apr. 2, 2015, which claims priority to Provisional Application Ser. Nos. 61/974,065, filed Apr. 2, 2014; 62/003,616, filed May 28, 2014; and 62/019,679 filed Jul. 1, 2014. These prior applications are also herein incorporated by reference.

FIELD OF THE INVENTION

The field of the invention is settable downhole tools for temporarily isolating zones in a well.

BACKGROUND OF THE INVENTION

Downhole tools such as frac plugs must both seal the wellbore during a well completion operation, such as fracking in the zone above the tool, and then subsequently permit fluid flow through the wellbore. Rubber and other elastomeric materials are commonly used as seals in settable downhole tools. While elastomeric materials function well as seals, they may interfere with completion operations, sometimes gumming up the mill head during milling the tool out, require tool retrieval, or otherwise delay or interfere with production.

SUMMARY OF THE INVENTION

A settable downhole tool is disclosed with a dissolvable metallic split ring sealing assembly which provides a "good enough" metal to metal seal with the casing. An embodiment tool substantially or completely isolates zones in the well so the well can be fraced, and then the tool substantially or completely dissolves in the wellbore's natural downhole fluids so completion and production operations can begin without milling out or drilling out the tool or other intervention on the tool from the surface.

The sealing element in conventional settable plugs is often an elastomeric seal, which is expandable during setting to seal against the casing. It is typically comprised of a polyurethane, rubber or a rubber-like elastomer. Milling out plugs which have rubber or rubber-like polymer seals sometimes creates problems when the milling head encounters the seal. Elastomeric seals sometimes tend to "gum up" the milling head and leave gummy debris in the hole, which can create problems during completion operations. Embodiments are disclosed in which the sealing element does not have to be drilled out, but rather degrades together with the plug generally in the presence of completion, production or formation fluids or fluids added from the wellhead. The elastomeric seal and problems associated with it may be eliminated with the disclosed dissolvable metallic sealing rings.

Non-elastomeric sealing elements for settable downhole tools for controlling fluid flow in a cased wellbore, more specifically, downhole tools having sealing elements comprised of metallic split rings and, in some embodiments, having no elastomers, are disclosed. The split rings may take a variety of shapes. Embodiments for a mandrel-less, settable downhole plug configured to block the flow of a fluid through the casing in a set and blocking position, and allow the flow of fluid therethrough in a set and unblocked position are disclosed.

Configurations and use of one or more expandable split rings for sealing or packing off a settable downhole tool against the casing are disclosed. In one embodiment, the tool is used without expandable rubber or rubber-like elastomers. In some embodiments, the downhole tool is used in conjunction with fracing a formation during completion operations. The split rings, in some embodiments, are degradable and may or may not be used with tools that have other degradable parts to eliminate the need for drill out. The split rings have a wide outer face and are adapted to seal off a casing (especially, in an embodiment, when used with a sand bearing fluid), when the downhole tool is set, and in some embodiments, to dissolve after a period of time, typically along with other elements of the tool, to avoid having to mill out the tool.

Methods of treating a downhole formation comprising positioning a temporary plug in a well casing, the plug having a mandrel, slips, cones and a split ring sealing assembly and/or expanding petal sealing rings are disclosed. During setting, the cones urge the sealing rings and the slips (and, in some embodiments, an elastomeric sealing element) against the casing. Well completion methods may include introduction of a fluid, such as fracing fluid, containing multiple plugging particles or a proppant, which may be sand particles, into the well after the plug has been set. Well operations may include introduction of a fluid under pressure and containing multiple sand particles or other proppants into the well upstream of the plug, after the plug has been set.

The sealing assembly may, in one embodiment, substantially dissolve in a downhole fluid, natural or introduced at the wellhead, over a period of time after use as a plug in the well. Wellbore fluid or downhole fluid sufficient to dissolve the tool may sometimes have a pH less than about 7 and be at a temperature of about 200° F. or less, and in some cases about 150° F. The split ring sealing assembly may comprise one or a plurality of nested, split rings, each split ring having a circumferentially expandable body.

The split ring sealing assembly may comprise at least one expandable C-shaped split ring. During setting, the plug urges the expandable C-shaped rings radially outward to form a seal between the plug and the casing.

The split ring sealing assembly may comprise a plurality of split rings, expandable on setting, each having an outer and an inner diameter, with, in some embodiments, a single full split extending between a leading edge and a trailing edge of the ring. Setting the plug urges a wide outer surface face of the ring against the casing as the plug expands the rings at the ring's split. Setting the plug may cause the split ring sealing assembly to initially form a "good enough" or other partial (not fully fluid tight) seal with the casing.

An embodiment is disclosed which creates a good enough seal. Targeting a good enough seal, rather than in instantly perfect seal, permits greater tool design latitude. A "good enough" seal is a seal between the tool and the casing which is not an absolute fluid tight seal, at least initially, but which is a good enough seal that it sufficiently isolates a zone above the tool from a zone below the tool so the zone above the tool can be usefully fraced or subjected other completion or production operations. If the tool creates a partial fluid tight seal with the casing, then proppants or other particulates such as sand, introduced into the wellbore will tend to pile into or pack on top of the set tool. If the tool to the casing partial seal is imperfect, but tight enough, these materials will pack on top of the tool, "packing in off," i.e. the pack of materials on top of the tool in combination with the tool's partial seal sufficiently isolates a zone above the tool from a zone below the tool so the zone above the tool can be usefully fraced or subjected to other completion or production operations. If the tool creates a partial fluid tight seal with the casing which leaks enough that enough fluid containing proppants, sand etc. leaks between the tool and the casing, but which is tight enough that the proppants, sand etc. seal the leaks between the tool and the casing, this also creates sufficient isolation between the zones so the zone above the tool can usefully be fraced or subjected to other completion or production operations.

There are no black-and-white boundary lines between "good enough" seals, "packed off" seals, or "jamming" seals. However accomplished, in some embodiments, an initial incomplete seal is formed between the tool and the casing and it is or becomes a sufficiently fluid-tight seal with the casing that fracking or other completion or production operations can be usefully undertaken in the zone above the tool in functional isolation from the zone below the tool.

After formation of the substantially fluid tight seal and after other completion operations, the split ring sealing assembly dissolves sufficiently that the plug is no longer sealed to the casing so wellbore fluid, such as formation fluid, may flow through the casing.

Plugs are typically run in with a setting tool that may be ballistic, hydraulic, electric or mechanical as known in the art. Setting tools typically set the plug by pulling the bottom of the plug up relative to its top, the longitudinal compression of the plug moves the split rings radially outward to engage the casing inner wall. Further pulling upwards on the bottom of the plug compresses the plug's slips and wedges (or cones) longitudinally against the plugs' split rings, forcing the rings radially outward against the casing. Being forcefully pressed radially against the casing, the split rings sealingly engage the casing inner wall, creating (especially with trapped particles as discussed above) a functional seal against fluid flow between the plug and casing.

The disclosed embodiments permit the sealing element to be comprised of a metallic split ring rather than or in addition to a solid, unsplit rubber or rubberlike elastomer. In some of the disclosed embodiments, a sealing element is shown which does not "gum up" the milling head or leave gummy debris in the hole when drilled out. In some of the disclosed embodiments, a metal or non-metal split ring sealing element does not have to be drilled out, but rather degrades together with the plug generally in the presence of downhole fluids or fluids added at the wellhead.

Even at lower wellbore fluid temperatures, such as about 200° F. or less, an expandable split ring embodiment serves functions similar to a conventional rubber or rubber-like elastomer seal, namely to seal the plug against the casing to substantially preclude fluid movement around the plug and through the casing. When compressed between the plug's wedge elements and slips during setting, the outer face surface of the expandable split ring radially expands against the well casing, sealing the plug to the casing.

In an embodiment, a settable tool is provided with a combination of dissolvable metal and dissolvable acid polymer elements of Applicant's split ring assembly. In some embodiments, the split ring is made from a degradable magnesium alloy that degrades in downhole fluids, such as acidic fluids. Such a settable downhole tool will be especially useful as the dissolvable elements of such a tool will dissolve well in low temperature downhole fluids, where a rubber or polyurethane elastomer will either not dissolve or, if dissolvable, will not dissolve well or will dissolve too slowly.

In another embodiment, a pair of adjacent split rings have a tongue in groove engagement in which one ring's tongue engages a groove in the adjacent ring to cause the split rings to maintain their engagement while each is ramped outward on a separate ramping surfaces. A ramping surface may be part of a cone.

BRIEF DESCRIPTION OF THE DRAWINGS

FIG. 4B1 is a cutaway view.

DETAILED DESCRIPTION OF THE ILLUSTRATED EMBODIMENT

Figure 1:
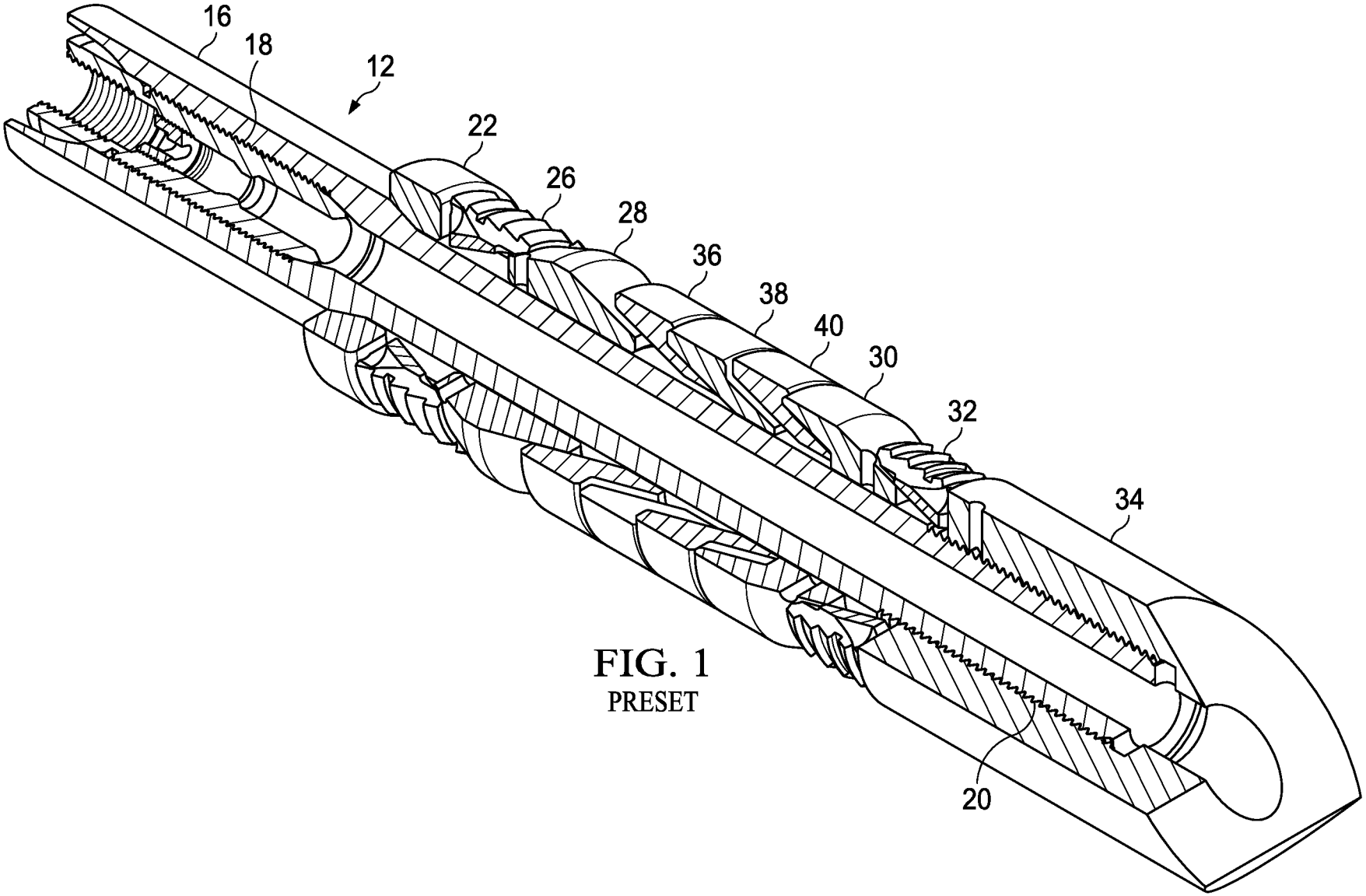
FIG. 1 is a perspective partially cutaway view of a downhole tool (preset) incorporating the sealing split rings and other novel elements of Applicant's downhole tool.

Applicant's illustrations show a settable downhole tool 10 having novel elements, including a multiplicity of split ring sealing elements 36/38/40. Two or more adjacent split rings are sometimes referred to as a split ring assembly. Applicant's downhole tool 10 may be run in and set with wireline, hydraulics, mechanically or in other ways known in the art, to engage, in a set condition, the casing and may be used, for example, in fracing operations. In some embodiments, Applicant's downhole settable tool 10 includes structural elements, all or some of which are degradable or dissolvable in a natural or introduced downhole fluid. In some embodiments, some or all of the structural elements may be made from a degradable acid polymer, such as polyglycolic (PGA) or polylactic acid (PLA), degradable or dissolvable aluminum alloy or magnesium alloy (or other metal alloys), such as found in US Publication No. 2015/0285026, incorporated herein by reference, or a combination of these degradable/dissolvable elements.

In some embodiments, a sealing element, packing or pack off element is provided, which differs from the standard plastic or elastomeric material/rubber that is used in many prior art settable devices for fluid sealing a downhole tool to the casing (typically along with slips for gripping) to perform completion operations, such as fracing. Instead of relying upon the elastomeric or plastic nature of the material of prior art pack off elements alone, the disclosed sealing element relies, at least in part, on splits in the rings, such as 36, 38 and 40, and flexibility of the material (typically metallic) of which it is made, to allow it to expand without shattering or cracking. Split rings may be metallic (aluminum, magnesium, ductile metals and alloys) or non-metallic, including degradable polymer acids, fiber resin or other composites. Deliberately creating a full split in the sealing element, particularly where it meets the casing is counter-intuitive. Typical, elastomeric pack off or sealing rings are often designed to provide a full seal cylindrically against the casing and conform to the sometimes irregular shape of the inner wall of the casing. The disclosed split ring configuration, however, produces a functional "good enough", substantial or partial seal, at least initially, with the casing, especially in combination with introduction of a pressurized particulate bearing fluid above the tool.

The structure and function of mandrel 12, seen in FIGS. 1-3B and FIGS. 5A-5C, may be similar to prior art mandrels, but in some embodiments, the mandrel may be a dissolvable material, such as an aluminum, magnesium, aluminum alloy or magnesium alloy (a metal and its alloy are both definitionally included when the term metal" is used herein unless otherwise noted. For example, "aluminum" as used herein is defined to include both aluminum and aluminum alloys unless otherwise noted.). The mandrel may be other suitable metal or a dissolvable acid polymer (such as PGA or PLA). It may engage a setting tool to be set in ways known in the art and typically includes an internal conduit, bore or channel and may have internal and/or external threads as illustrated. Mandrel 12 may include, for example, at an upper end, a lower end, and a ball seat 19. Ball seat 19 is dimensioned to receive frac balls in ways known in the art, which frac balls may, in a preferred embodiment, be a degradable metal or degradable polymer such as an acid polymer.

Degradable or dissolvable means substantially degradable or dissolvable in a downhole fluid which may be a naturally occurring fluid or may be an introduced fluid. It may be fresh water, a brine, an acid solution or frac fluid or other fluid.

Mandrel 12 may include inner walls 14, outer walls 16, and may have upper internal mandrel threads 18, and lower external mandrel threads 20. A number of structural elements may be entrained upon the outer surface of the mandrel and be shaped and function in ways known in the art. These include a top ring 22 having a lower side wall 24 for engaging the mandrel outer wall sloped surface 16*a* (see FIG. 3), an upper slip with wickers 26 and a lower slip with wickers 32 that may function in ways known in the art. A top cone 28 and a bottom cone 30 (FIGS. 1-3B) and 31 (FIGS. 5A-5C) may have some functional and structural similarities to that in the prior art, but also may have novel configurations and uses which will become apparent from the illustrations of the concepts stated herein. A bottom shoe or sub 34 may be used which, in one embodiment, is snub nosed for interlocking with an upper end of an adjacent and lower plug (not shown) in ways known in the art.

Figure 2:
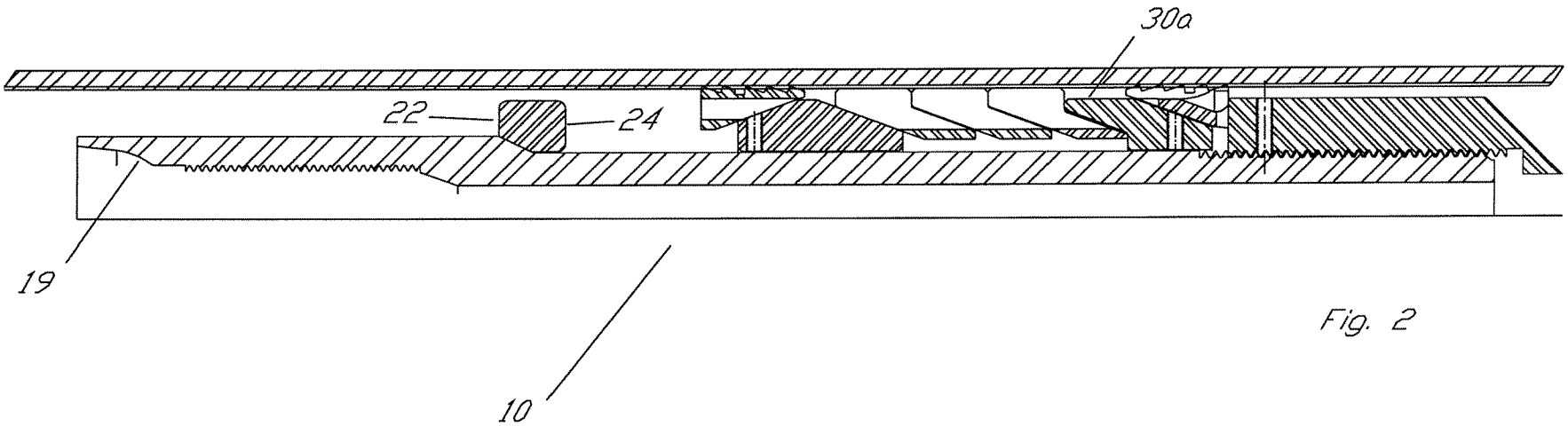
FIG. 2 is a partially cutaway quarter sectional view of Applicant's tool in a set configuration in a casing.
Figure 3:
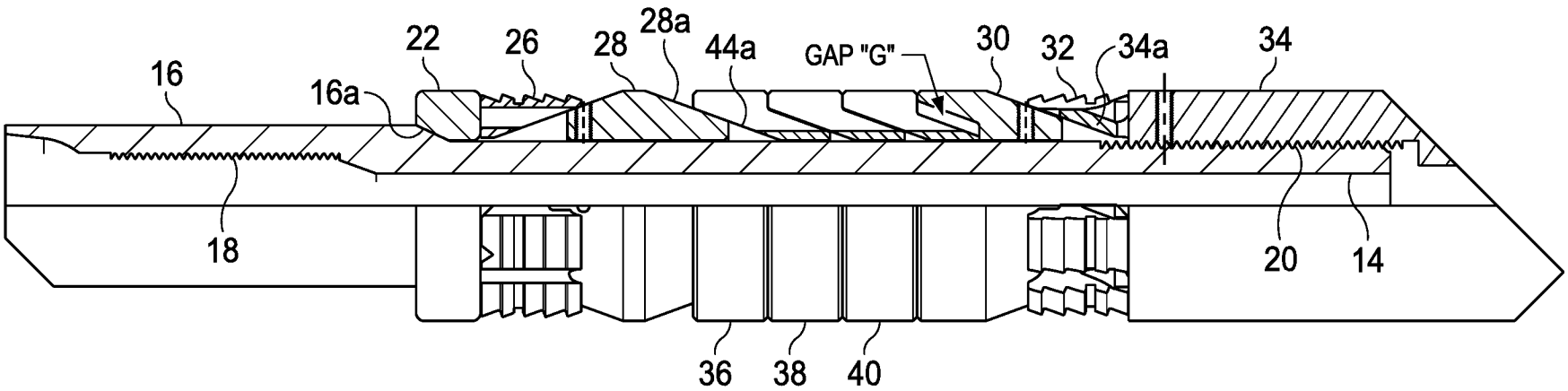
FIG. 3 is a cutaway quarter-sectional view of Applicant's tool in a preset configuration (casing not shown).

Turning to FIGS. 2 and 3, a set (or post set) and preset (or unset) configuration of downhole tool 10 is illustrated. As seen in a preset configuration (see FIG. 3), the cylindrical outer surfaces of a split ring assembly comprising three adjacent sealing split rings 36/38/40 are seen to be at or below some of the outer surfaces of some other elements of the tool. Moreover, sealing split rings 36/38/40 may be, in some embodiments, "nested" or telescoped one with respect to the other. The first ring 36 is seen to have an angled inner surface engaged with the angled downhole surface of top cone 28 as seen in FIG. 3. The setting operation "jams" slips 26/32 into the casing as the cones cause split rings 36/38/40 to each circumferentially expand at its split 50 (which widens during setting) and move radially outward with respect to a central longitudinal axis of the tool so the wide cylindrical outer face 42*a* of each ring contacts and becomes generally flush with the casing as seen in FIG. 2.

Turning now to the structure of the split ring embodiments and with reference to the FIGS. 4A-4D, it is seen that rings 36/38/40 may be similarly shaped. The rings may have an outer surface 42 (see FIG. 4D), an inner surface 44 (see FIGS. 4B and 4C), a leading edge 46, and a trailing edge 48. They may be split fully through in both preset and set configurations so as the wedge compresses them outward as the tool sets, they controllably spread open like petals of a flower, expanding at their preset splits 50, the gaps widening as the rings expand without the preset solid bodies of the rings breaking during the expansion (compare FIG. 3 to FIG. 2). Alternatively, the rings may be split only partly through, expansion of the rings during setting breaking the uncut portions of the rings. Cutting the rings only partly through facilitates cutting each of the rings and more than one location. This facilitates separation of the ring only occurring at the cuts or gaps during setting, rather than the rings breaking uncontrollably at "solid" portions of the ring. Whether due to one full cut, one or more partial cuts, making the ring of a material which is somewhat malleable helps the "solid" portions of the ring tightly seal against the casing without breaking.

Figure 4A:
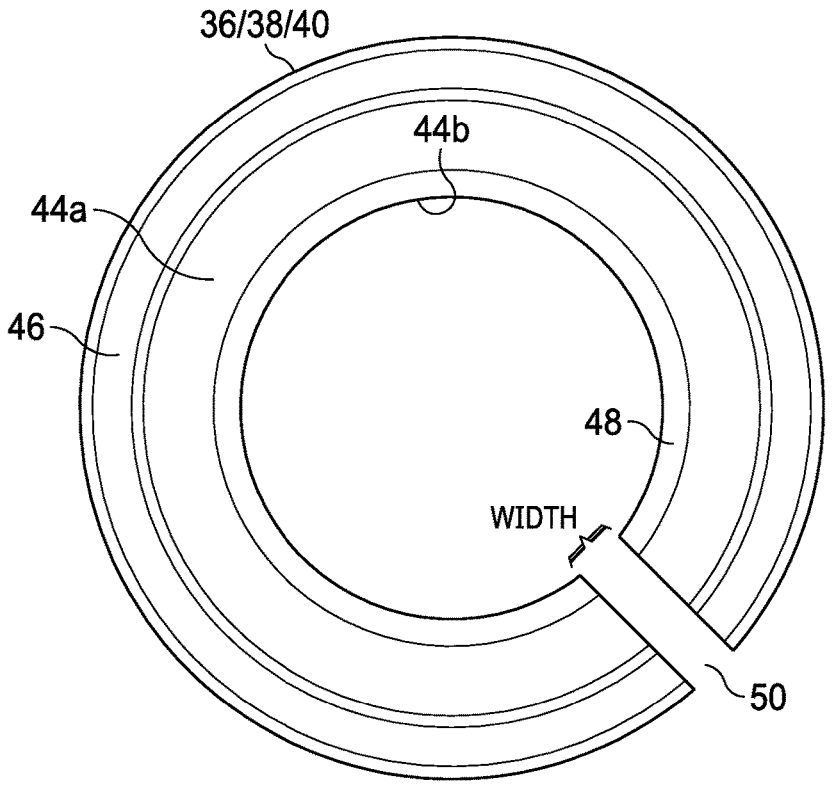
FIG. 4A is a front view.
Figure 4B:
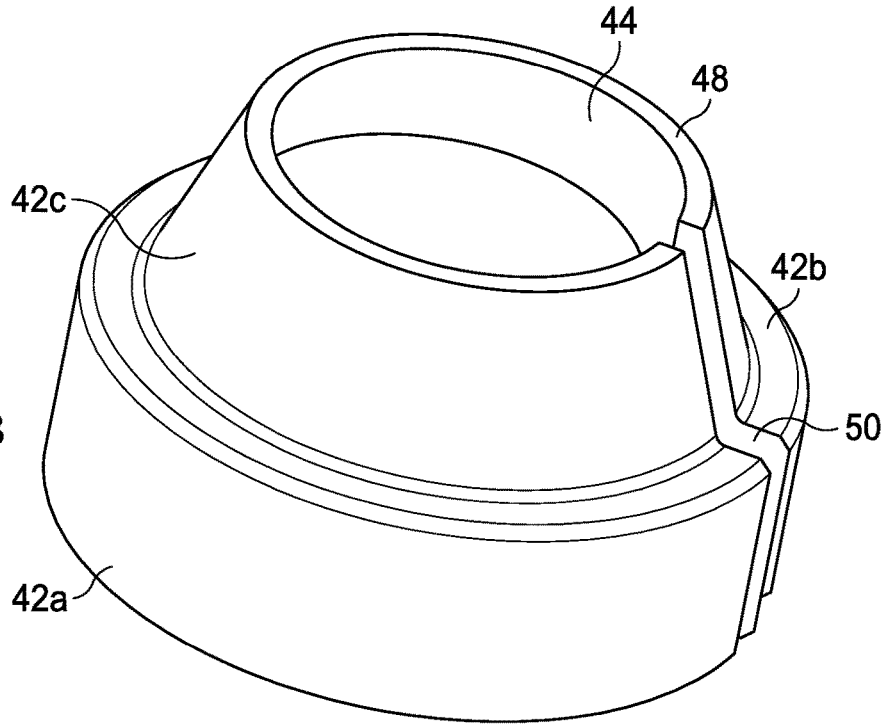
FIG. 4B is a perspective view.
Figure 4D:
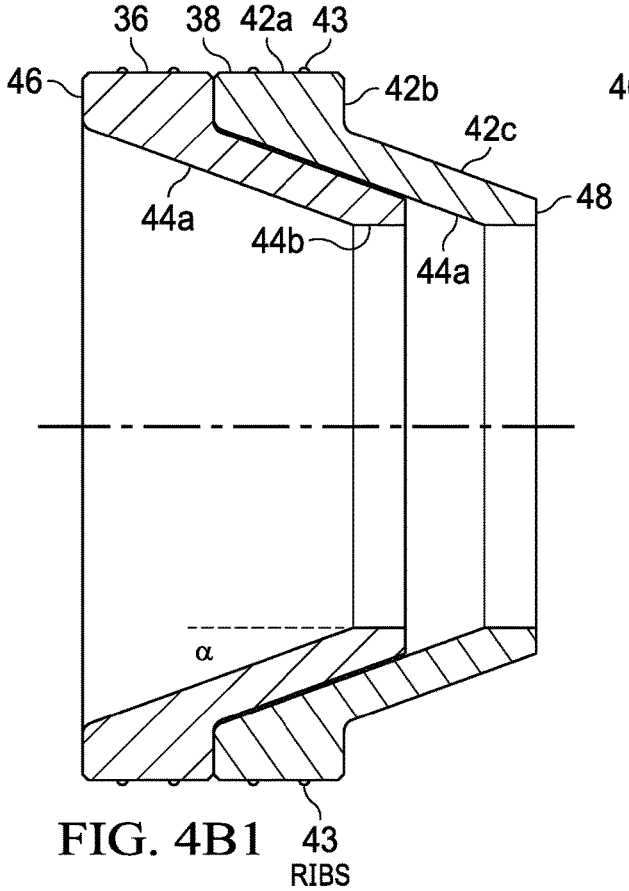
FIG. 4D is a side view, all showing a split ring for use with Applicant's settable tool.
Figure 4D:
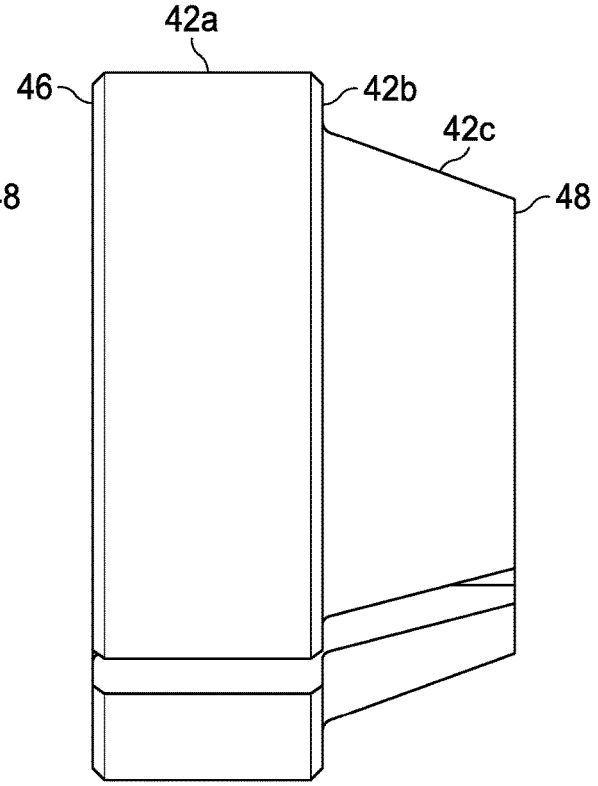
Figure 4C:
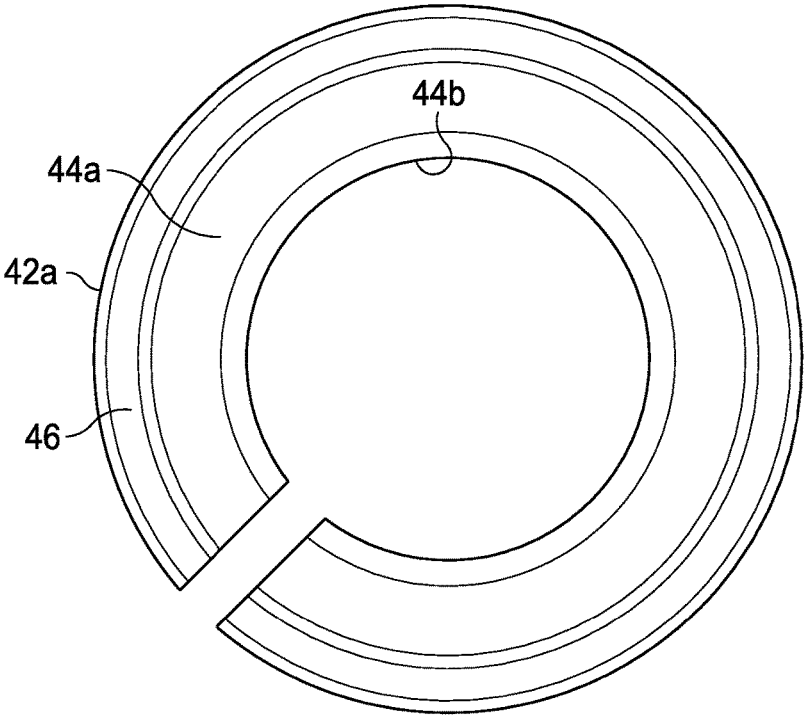
FIG. 4C is a rear view.

In an embodiment, outer face surface 42 may be configured to include cylindrical outer face 42*a* for resting, in a set position, flush against the cylindrical inner walls of the casing, a driven shoulder 42*b*, and an angled surface 42*c* (see FIG. 4D). Some embodiments have a cylindrical outer face 42*a* with narrow, ribs 43 (see FIGS. 4B1 and 4D) to help seal against the casing when set and help trap sand or other proppants from above the tool. The ribs may or may not be made of the same material and may or may not be integral with the non-rib portion of the ring—for example, a dissolvable aluminum or magnesium alloy. The ribs may assume different shapes. Non-limiting examples are circling the outer surface as in FIG. 4B1 or a discreet "chevron" pattern. Inner surface 44 may include a cone-shaped angled surface 44*a*, and a cylindrical surface 44*b*. Angled surface means angled with respect to the longitudinal axis of the tool and flat means parallel to the tool's axis, although the flat surface is cylindrical about the longitudinal axis, for example, as seen (three dimensionally) in FIG. 1. Angled surfaces 42*c* and 44*a* of the same ring may be generally parallel when viewed in two dimensions (see FIGS. 4B1). These ring configurations may be referred to as "petal shaped." Outer and inner angled surfaces of adjacent rings are generally flush (see FIG. 4B1). The angle "alpha" (see FIG. 4B1) may preferably be in the range of about 15-50° or about 20°.

Figure 3A:
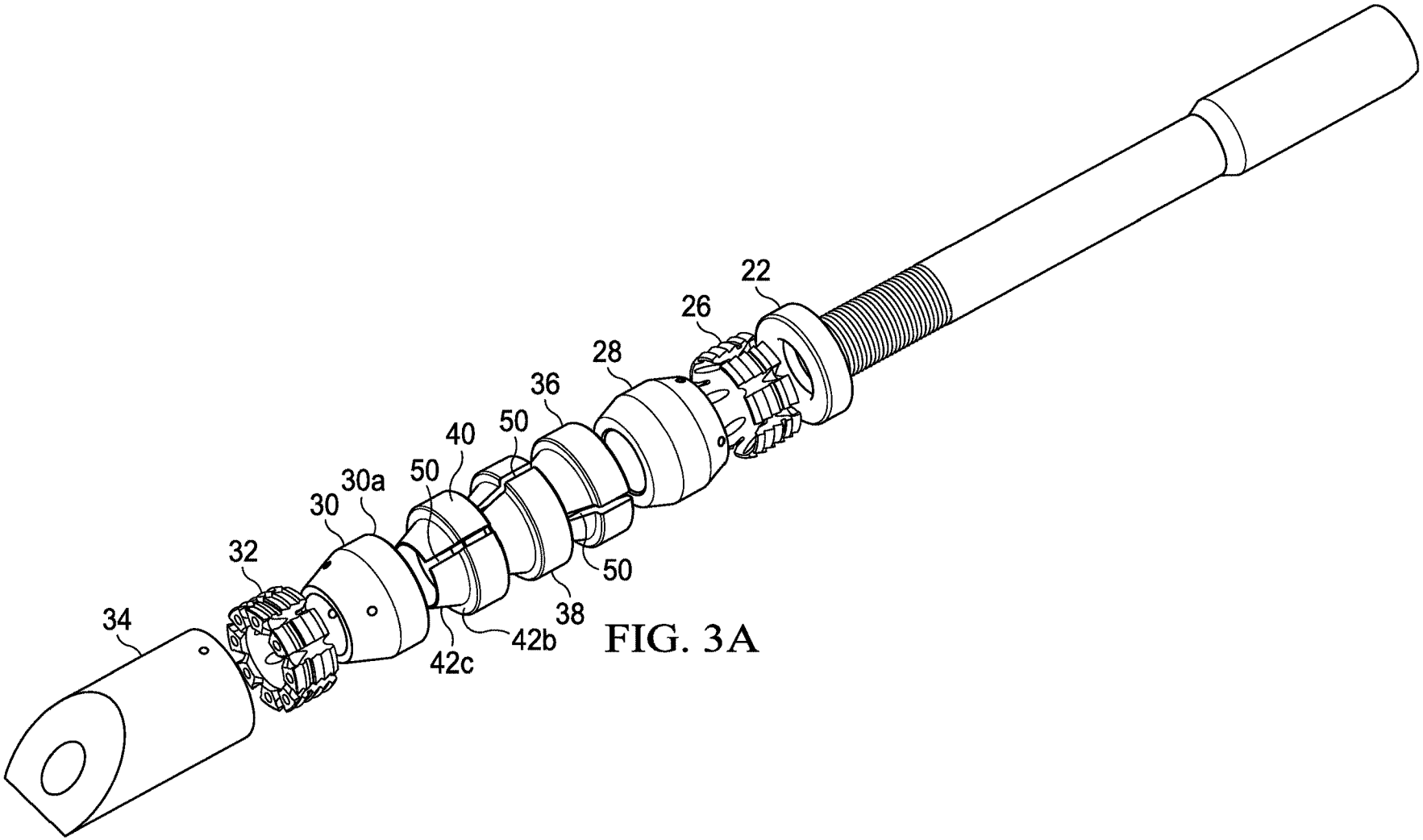
FIGS. 3A and 3B illustrate exploded perspective and elevational views of the embodiment of FIGS. 1-3.

In an embodiment, full split 50 in the split rings allows circumferential expansion of the split rings under the impetus of compression between load ring 22 and bottom sub 34 during the setting process without breaking the split rings. In some embodiments, a lower slope of 30° or less on either the upper or lower cone expands the split rings toward the casing as the tool is set in the casing. More specifically, it is seen that lower cone 30 of FIG. 1-3B may have a drive shoulder 30*a* that abuts against driven shoulder 42*b* of lowermost ring 40 (see FIG. 3A, for example). Moreover, in the unset position, there may be a gap "G" as seen and labeled in FIG. 3 between angled surface 42*c* of lowermost split ring 40 (see FIGS. 1-3) and ramp or angled surface of bottom cone 30. Gap G in the unset configuration is located above the lower wall of the lower portion of driven shoulder 42*b*.

Inner surface 44 has conical or angled surface 44*a* and flat, but cylindrical surface 44*b*. Cylindrical surface 44*b* may lay flush against the outer surface of mandrel 12 in the preset or unset configuration illustrated in FIG. 3. During setting as the rings are deployed, they move both axially along the length of the mandrel. Cylindrical surface 44*b* may rise off the inner surface of the mandrel to assume the position illustrated in FIG. 2, as outer face 42*a* moves towards during setting and is compressed against the casing when the tool was set.

During setting, the setting tool will typically provide an upward axial force on the elements entrained about mandrel 12, while holding top ring 22 in a fixed position. This creates compression between lower side wall 24 of top ring, and upper side wall 34*a* of bottom sub 34 (see FIG. 3) and urges the rings radially outward. In some embodiments, and elastomer is additionally used as a sealing element. In those embodiments the split rings of the split ring assembly do not directly contact the elastomeric, but rather directly contacts the inclined slope or surface of a cone for their radial expansion.

Figure 3B:
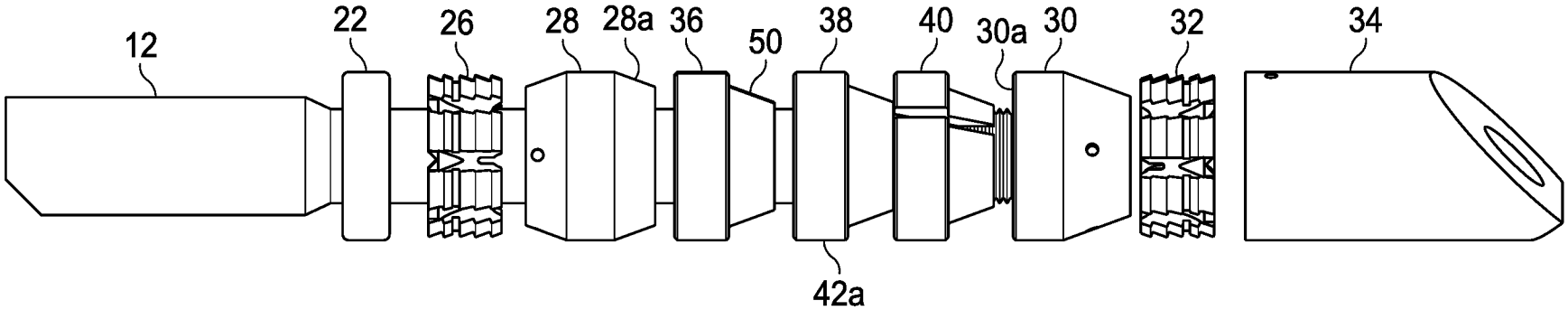

In ways known in the art, the compression generated in setting will drive and ultimately push slips 26 and 32 radially outward on cones 28 and 30 and drive the rings together and radially outward as seen in FIG. 3 under the impetus of the action of drive shoulder 30*a* of bottom cone 30 against driven shoulder 42*b* of ring 40. Bottom cone 30 drives the rings, the outward radial force provided by the lower inclined slope of the top cone acting on the top ring, which in turn interacts with the next lower ring. The nested condition of split rings 36, 38 and 40 places leading edge 46*a* of ring 38 against or close to driven shoulder 42*b* of ring 36. Parts other than drive shoulder 30 a of the lower cone may provide contact and drive or axially push the lower ring. Likewise, leading edge 46 of ring 40 abuts driven shoulder 42*b* of ring 38. Thus, an upward axial force applied along the tool's longitudinal axis is carried through from the lowermost sealing ring to the uppermost or top sealing ring 36. In some embodiments of the preset ring drive and driven shoulders are not directly abutting, axial movement of the rings expanding lower rings over the downward facing shoulders of the upper rings. Ring 36 will expand as a result of the axial force pushing it over angled surface 44*a* of top ring 36 which is pushed from angled lower surface 28*a* of top cone 28 (FIG. 3B).

In some embodiments, gap G may be in the range of about 1/32" to 3/8" or 1/8" to 5/8" (see FIG. 3). In some embodiments, full split 50 and unset rings 36/38/40 may be in the range of about 1/32" to about 5/16" or about 1/16 to about 1/4 inches wide (see FIG. 4A). Set, the split may open so it is between 1/2" and 3 1/4". In an embodiment, the tool has three sealing rings. The range of sealing rings may be from 1 to about 5 or more—as many as needed depending on the expected downhole pressure load on the tool. The width of cylindrical outer face 42*a* of the rings may be between about 1/4" and about 3" in one embodiment, about 1/2" to about 2" in another embodiment, and about 1" in a third. In another embodiment, the width is about 1/2 inch or more. The range of angles of cone/ring inclined surfaces may range from 15° to 70°.

In an embodiment, the rings are comprised of a dissolvable metal which will dissolve in aqueous natural downhole fluid having a pH of less than about 7. The metal rings 36/38/40 pressed against the casing to create a "good enough" metal to metal seal with the casing. In an embodiment, the rings are comprised of dissolvable magnesium. In other embodiments, the rings are comprised of other dissolvable metal's or other dissolvable materials. In an embodiment, the composition of rings 36/38/40 may be dissolvable or non-dissolvable and in a preferred embodiment may be dissolvable aluminum alloy or magnesium alloy. The incorporation herein by reference of the disclosures of U.S. patent application Ser. No. 14/677,242, make repetitions of its disclosures herein unnecessary.

In other preferred embodiments, the rings may be comprised of dissolvable polyurethane, a dissolvable polymer acid, such as polyglycolic acid or polylactic acid. Acid polymers may break down in a downhole fluid into a monomer comprising an acid, such as polyglycolic acid or polylactic acid or dissolvable metal alloys such as magnesium or aluminum. If there are other acid dissolvable metal elements of the tool or other elements of the tool that dissolve in acid, this release will synergistically assist in dropping the pH in the local environment to help dissolve such other elements of the tool that are dissolvable in an acidic environment.

In an embodiment, individual split rings are made of a high strength, dissolvable magnesium alloy, such as TervAlloy TAx-100E available from Terves, Inc., 24112 Rockwell Dr., Euclid, Ohio 44117. This magnesium alloy may be machined and has an ultimate tensile strength between about 43.0 ksi at 20° C. to 29.8 ksi at 150° C. Elongation is 10.3% at 20° C. and 43.6% at 150° C. In another embodiment, rings may be made of injection molded or machined SoluBall, a dissolvable polyurethane polymer, which can carry a maximum tensile load of about 683 N, has a tensile strength break at 0.0029 NPa, with a shore D hardness of about 65. Additional dissolvable materials may be sugar or glucose based material. Any suitable metal or non-metal, such as a polymer, an acid polymer such as a dissolvable PLA or PGA, may be used or even a rubber or plastic, which may be dissolvable.

Conventional downhole tools, plugs and packers typically use rubber sealing element made of Nitrile, I-INBR, FKM or sometimes TFE/P (AFLAS®). Typically, these rubber sealing elements are in the hardness range of about 65 to about 83 on the shore A scale. Split rings in Applicant's tool may use any of these as elastomers or none.

In an embodiment, the tool's sealing elements be petals comprised of a dissolvable polyurethane such as KDR that works best in wells greater than 200° F. due to its dissolution properties. Polyurethane is typically considered a plastic rather than a rubber. It's hardness is about 80 on the Shore A scale.

When the tool with split rings 36, 38 or 40 is used for fracing, it may be set and a ball dropped to close the plug and isolate zones to create upstream hydrostatic pressure responsive to frac fluid in the wellbore. When the frac fluid or other fluid contains sand (or other particulate matter) the sand will force its way in and around any gaps in the sealing element/split rings and tend to wedge into or jam against the casing and/or around the expanded split rings and other elements of the tool and help further block fluid flow. This jamming can occur in and about each of each of the ring's full splits 50. For the purpose of limiting fluid flowing through adjacent splits in the rings, the splits 50 are typically offset from splits on adjacent rings to make a more effective seal. For example, three rings 36, 38 and 40 may have their separate splits set 120° apart (equiangular), whereas two petals might space their separate splits 180° apart (again, equiangular).

Although greater separation may be desirable, it is believed that offsets of 30° or more may be sufficient to prevent fluid flowing through adjacent splits.

Figure 5A:
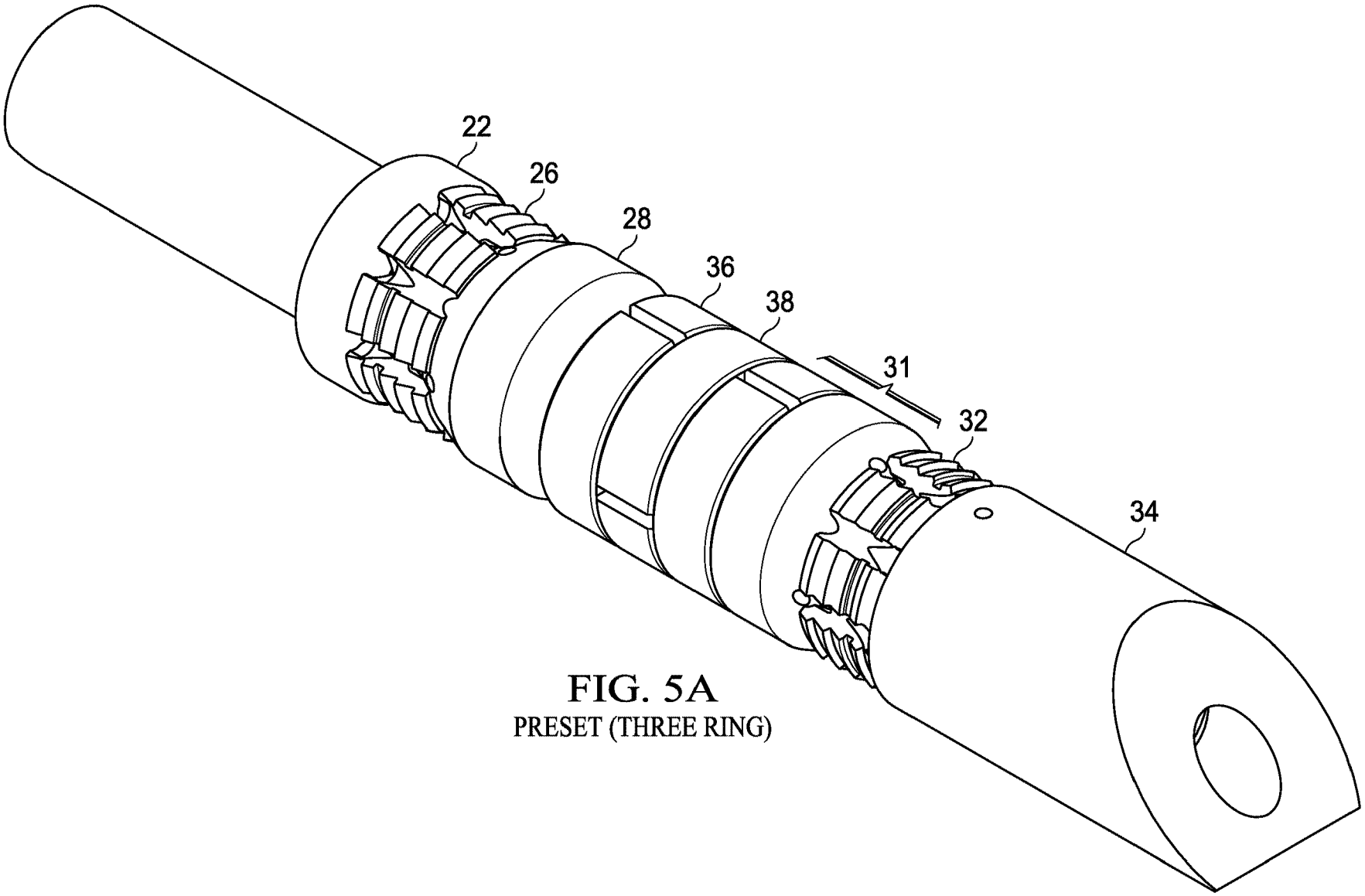
FIGS. 5A and 5B are quarter section and perspective views of an alternate embodiment of Applicant's settable tool with a weakened lower cone.
Figure 5B:
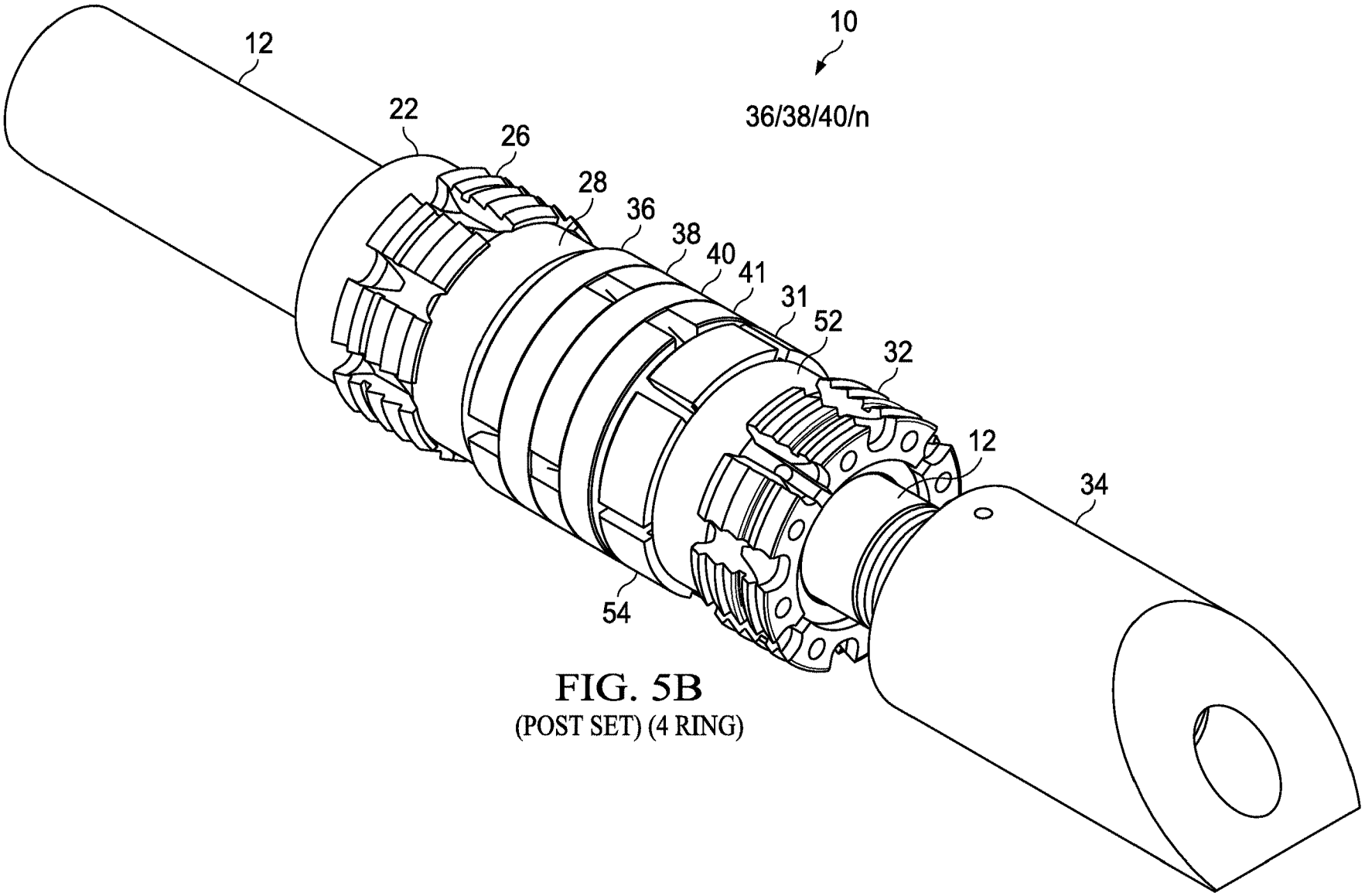
Figure 5C:
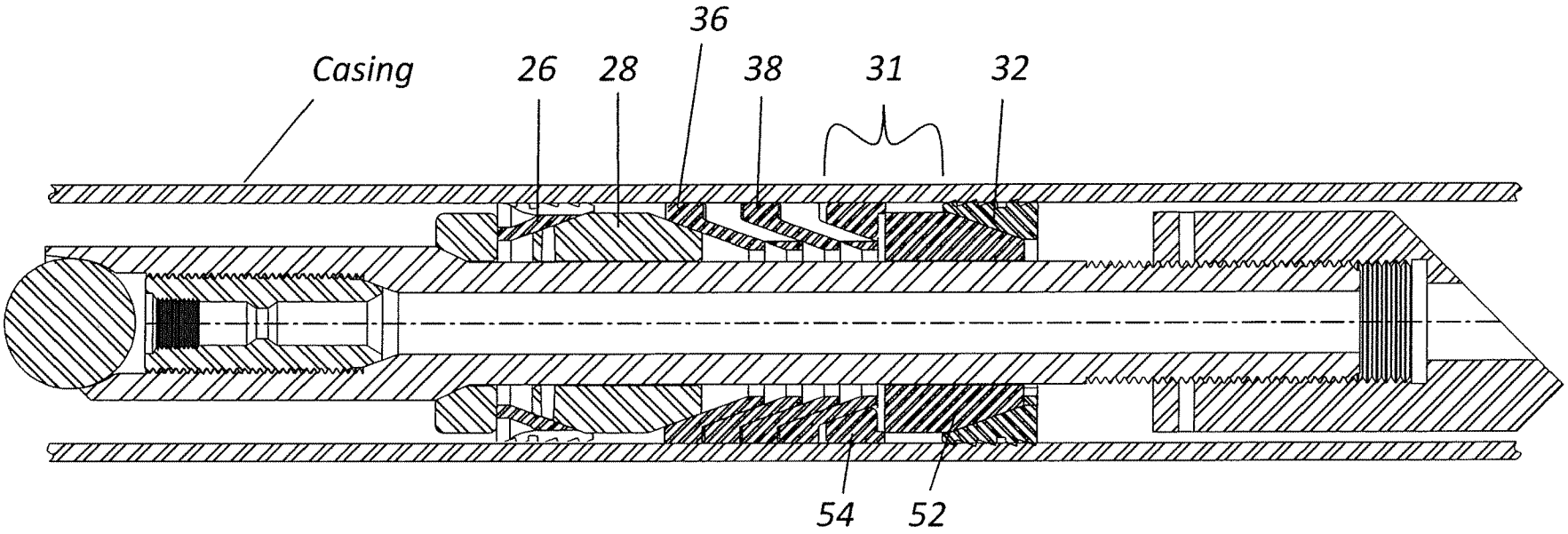
FIG. 5C is a half sectional view of the tool in a set position.
Figure 6A:
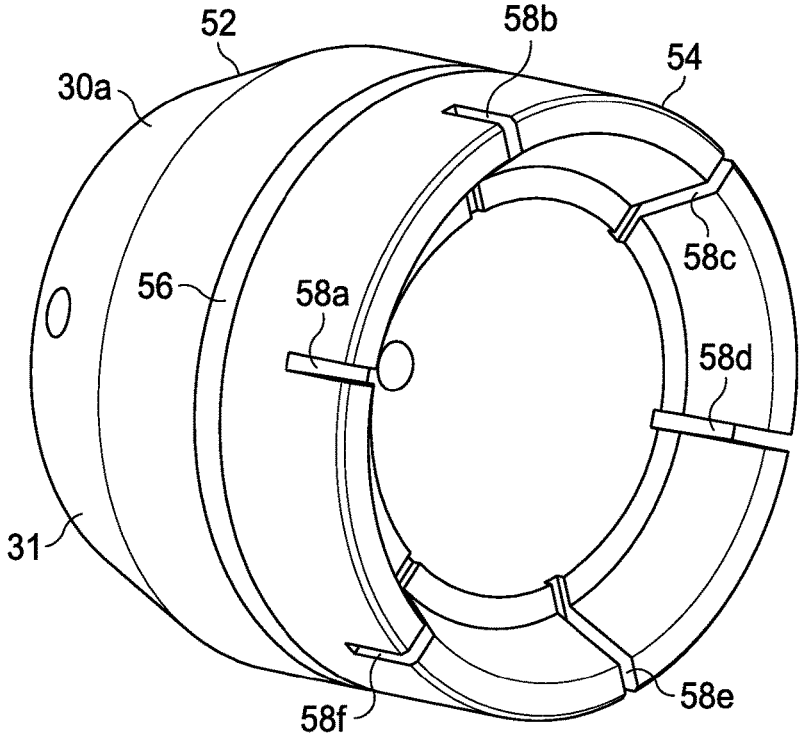
FIGS. 6A and 6B illustrate preset and set views of the weakened lower cone of the FIG. 5 series embodiment.
Figure 6B:
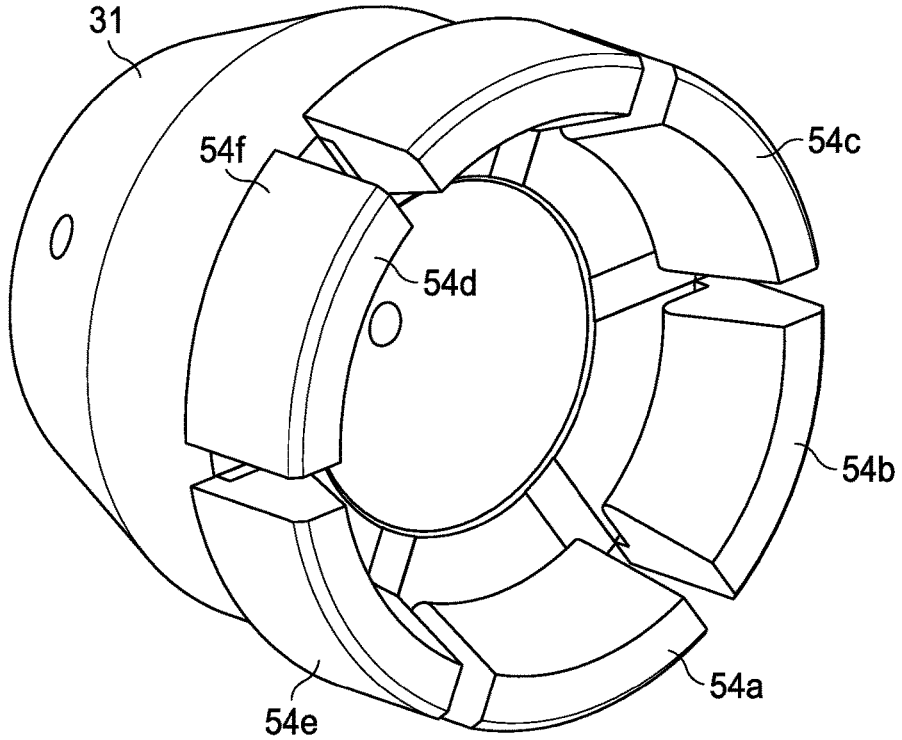

FIGS. 5A, 5B, and 5C (set), and FIGS. 6A and 6B illustrate an alternate preferred embodiment of Applicant's downhole tool. In this embodiment, or the elements of the earlier described embodiments are substantially the same, except lower cone 30, which is one piece before setting, but multiple pieces 52/54*a-e* after setting. During setting, a first slip incline or ramp portion 52 separates from second ring engaging portion 54 which in turn separates into several pieces, here 54*a*/54*b*/54*c*/54*d*/54*e*. In cone 30 of FIGS. 1, 2, 3, 3A, and 3B, the cone does not split or separate, and a gap is used between the cone tapered ID and the adjacent ring tapered OD to allow the ring to ramp outwards to the casing ID without obstruction from the cone below it. The function of lower cone 30 of FIGS. 5A-5C is to provide a linear drive to the rings of the assembly. The top cone provides radially outward force to slip 26, to anchor the slip to the casing. The top cone provides radial expansion of the rings. By providing a weakening at circumferentially cut portion 56, second portion 54 is separated from first portion 54 during setting, allowing the second portion to expand radially outward and break up to pieces 54*a*/54*b*/54*c*/54*d*/54*e* due to cuts 58*a*/58*b*/58*c*/58*d*/58*e*/58*f* therein. Setting provides for radially outward movement so the circumference of second portion 54 can expand. Any extrusion gap may be closed and a more effective seal may be provided. The force causing the outward breaking of second portion 54 may be provided for by movement of inclined surface 42*c* of the lowermost ring 41 in FIG. 5B as cone 30 moves axially along mandrel 12 during setting, in FIG. 5C for example.

FIGS. 7, 7A, and 8-13 illustrate a different tool (without split rings) from the other Figures, here, three embodiments of a casing plug 510 for engaging casing 512. Common to all three embodiments is the use of some embodiment of cylindrical sleeves 514/515/517 (see FIGS. 7, 7A, and 8), in combination with an embodiment of Applicant's bottom sub or cone 516/519 (see FIGS. 7 and 10 for embodiment with bottom cone 519 and FIG. 7A for embodiment with bottom cone 516). The sleeves define a longitudinal axis. It is seen that no mandrel is used.

Figure 7:
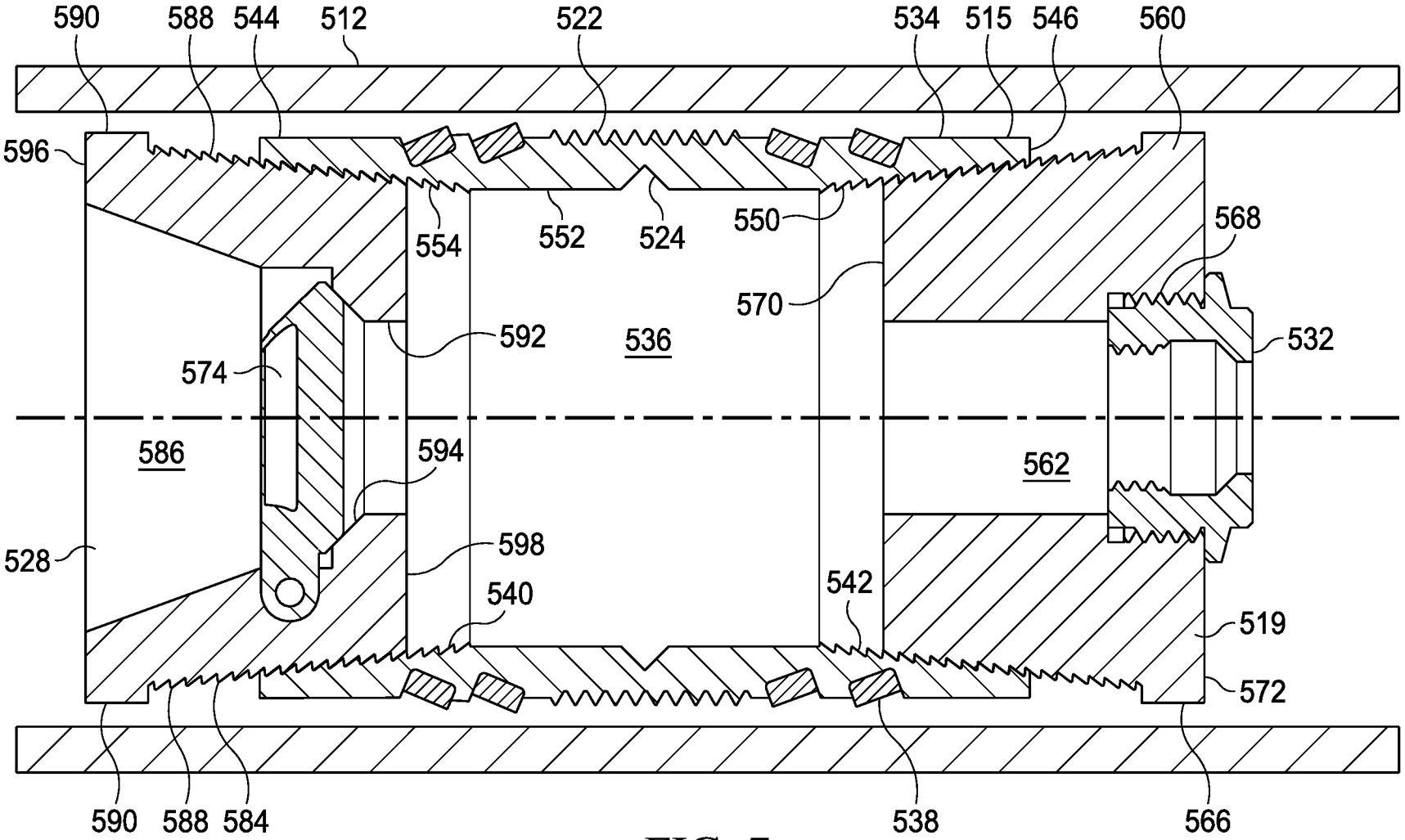
FIG. 7 is a cross-sectional view of a first embodiment of Applicant's mandrel-less casing plug in an unset position.
Figure 7A:
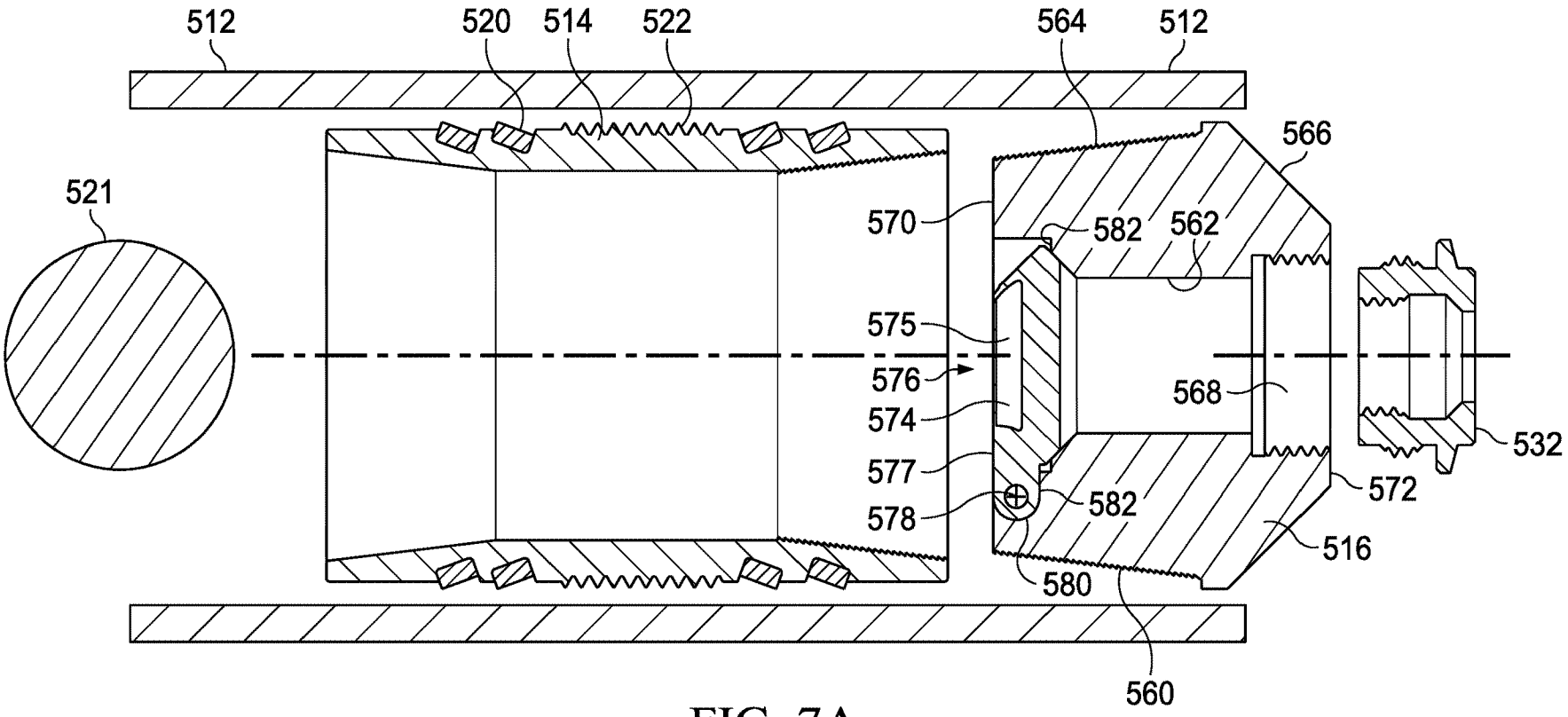
FIG. 7A is a cross-sectional view of a second embodiment of Applicant's casing plug in an unset position.
Figure 8:
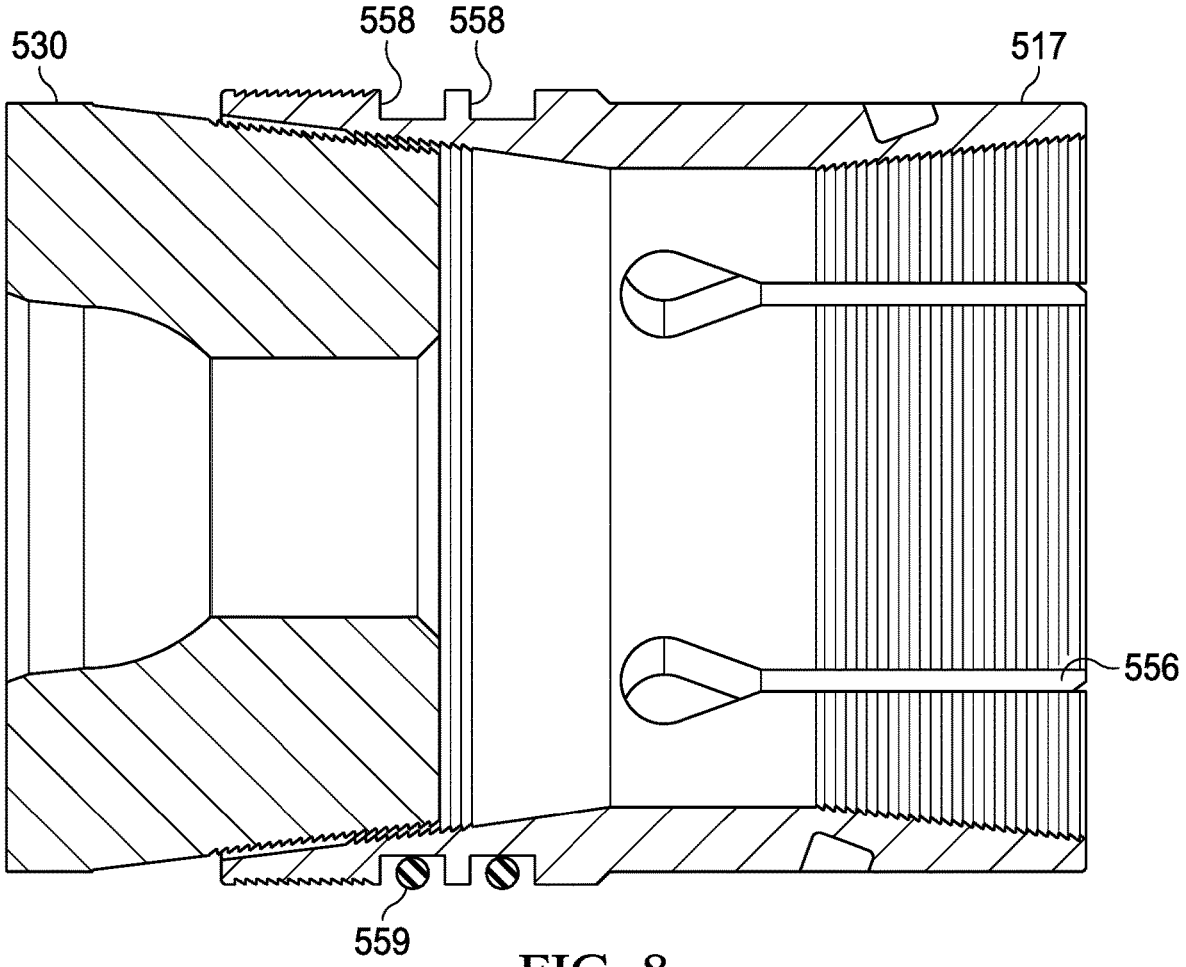
FIG. 8 is a cross-sectional view of a third embodiment of Applicant's casing plug in an unset position.
Figure 13:
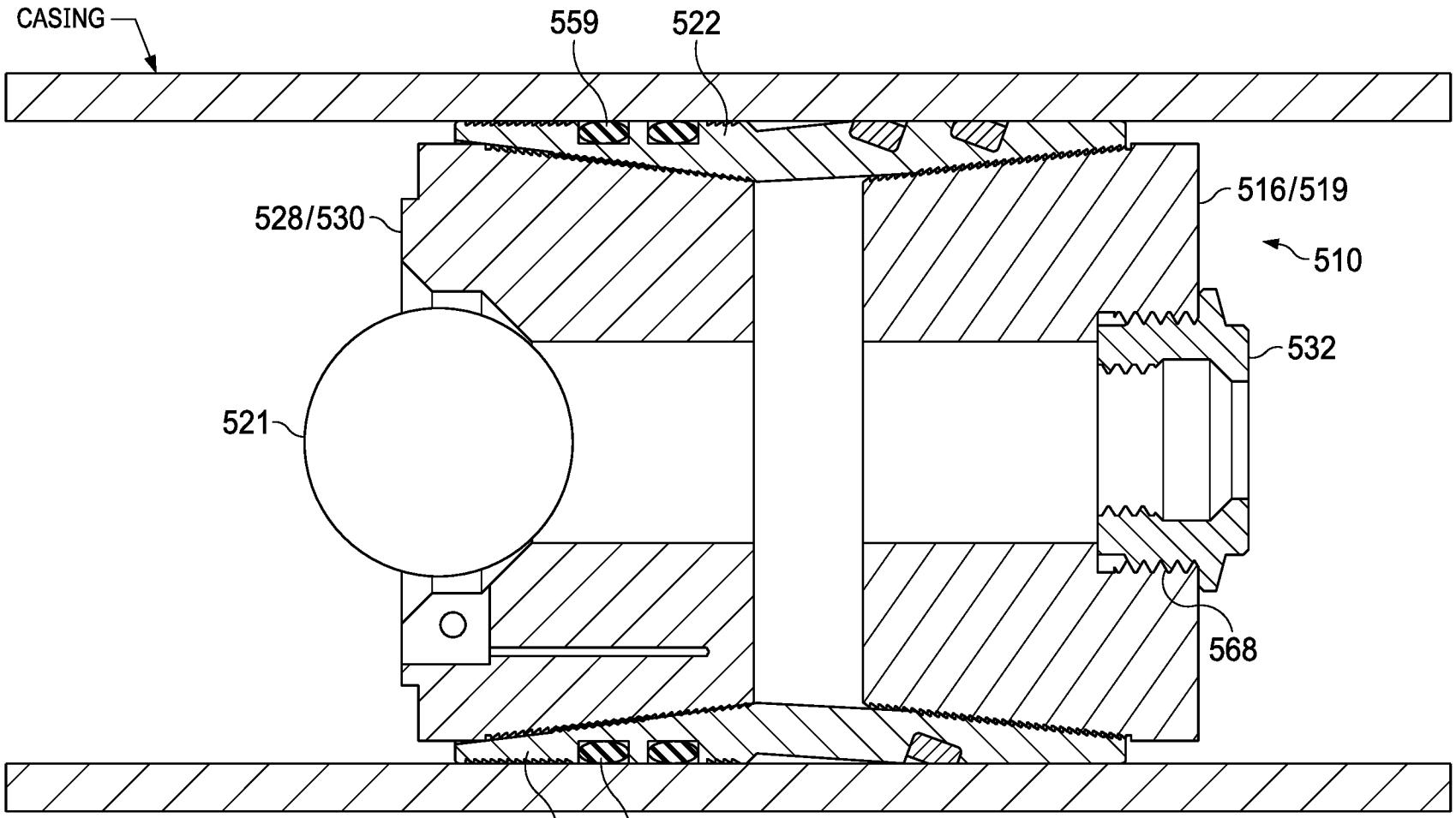
FIG. 13 illustrates a cross-sectional view of Applicant's casing plug in a set position in casing, selectively blocking flow from above the set tool.

Turning to FIGS. 7, 7A, and 8, it is seen that common to sleeves 514/515/517, are an outer surface 534, and an inner surface 536 defining a bore having a minimum internal diameter. Outer surface 534 may include button indents 538 with cast iron or other hard buttons 520 therein, the buttons for engaging the inner walls of the casing when the casing plug is in a set position as seen in FIG. 13. Inner surface 536 includes an upper/inner inclined wall 540 and an lower/inner inclined wall 542. Inner surface 536 may also include connecting inner wall 552 to connect upper/inner inclined wall 540, and lower/inner inclined wall 542. Lower/inner inclined wall 542 and sometimes upper inclined wall 540 typically includes multiple ratchet ribs 550.

Figure 9:
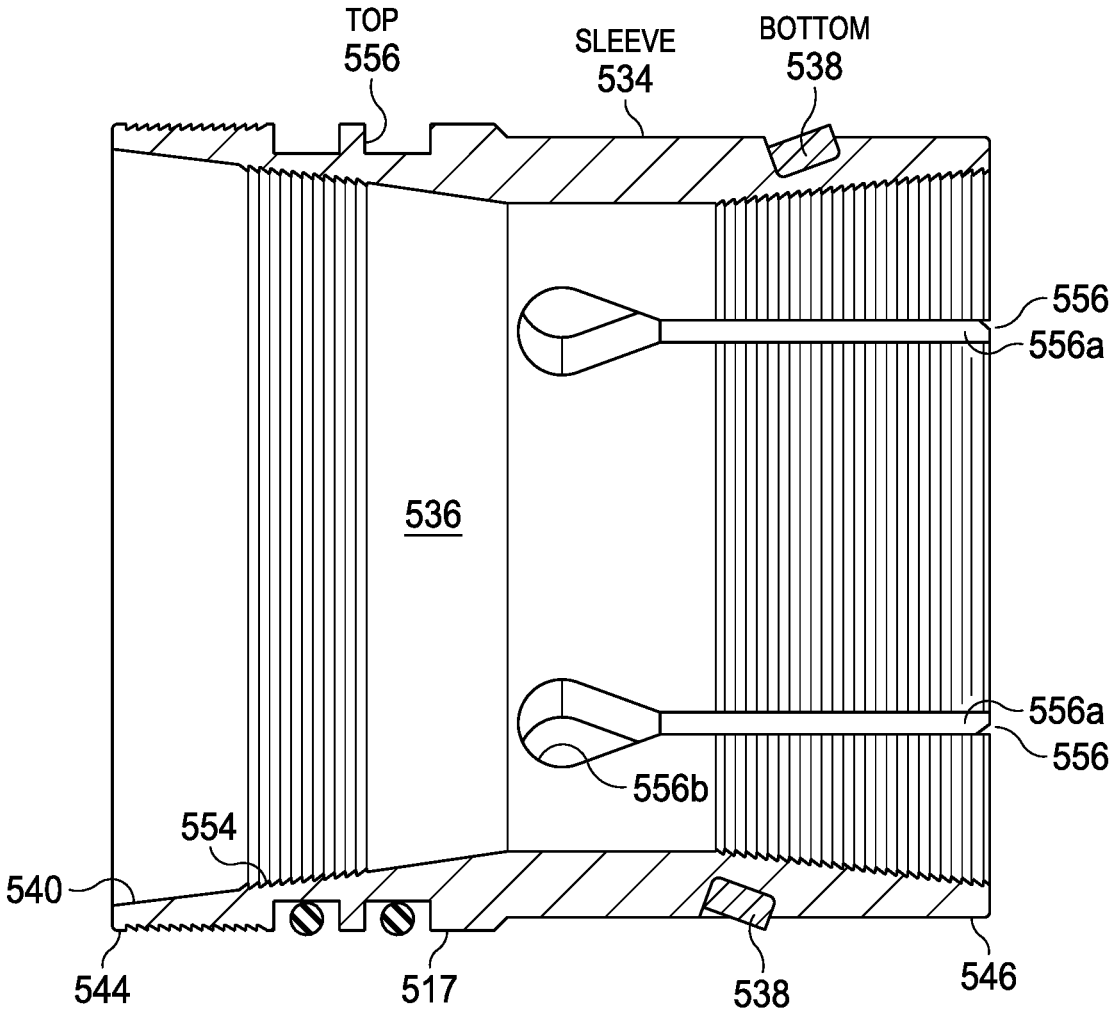
FIG. 9 is a cross-sectional view of an embodiment of a sleeve for use with Applicant's casing plug.
Figure 9A:
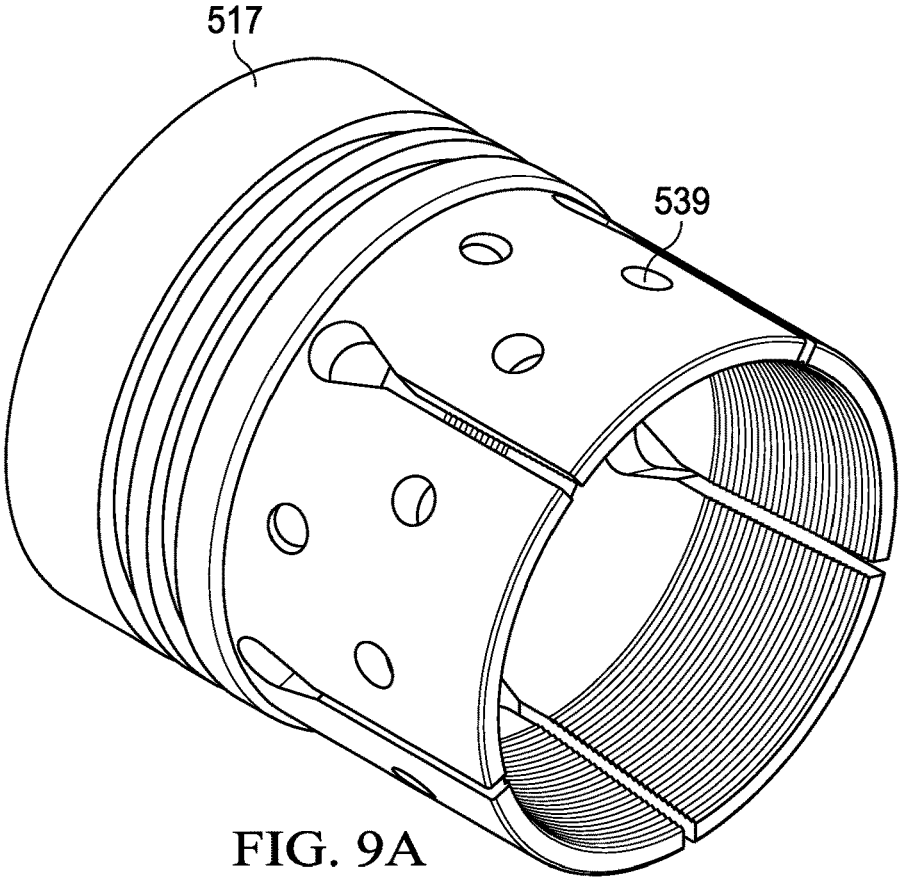
FIG. 9A is a perspective view of a preferred alternate embodiment of Applicant's sleeve having slots therein.
Figure 9B:
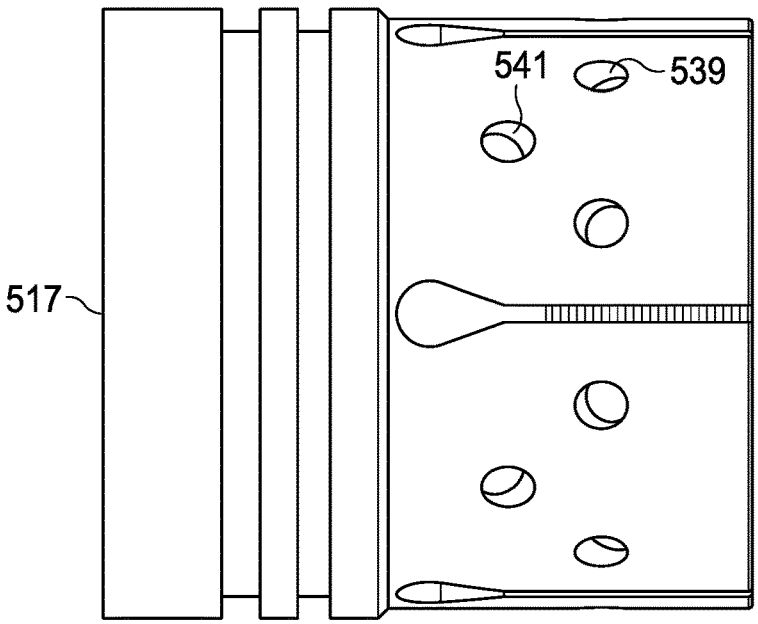
FIG. 9B is a side elevational view of the sleeve of FIG. 9A.

FIGS. 9, 9A, and 9B show that a lower row 539 of lower buttons 520 has more buttons than an upper row 541 of upper buttons. There is more area in the body of the slip to add more lower button anchors. Lower row buttons 520 may be canted with their faces angled upward, to best dig into the casing and resist downhole movement of the set plug. For the avoidance of doubt, a face which is angled below a perpendicular to the mandrel, i.e. the mandrel being a y-axis and an upward angle being a face below the perpendicular x-axis, is considered to be facing or angled upward. This is applies whether body of the object is above or below the angled phase. Upper row buttons in some embodiments may be canted with their faces angled downward, to best dig into the casing and resist upward movement of a set plug. Because downward pressure from above the plug on the plug during fracking is higher than upward pressure from below, in one embodiment lower row 539 has more lower buttons 520 than upper row 541 has buttons 520 in some wells, upper and lower slips having numerous upward facing and downward facing buttons may be necessary.

In some embodiments appropriate for some wells, all of the buttons are placed on a single slip body. In an example, where fracking above the tool is expected, more downward pressure resisting buttons will be used on the slip than upward pressure resisting buttons, and fewer buttons will be used than is typical in the industry. A preferred number of downward pressure resisting buttons is in the range of 3 to 8 buttons per square inch of casing ID. A preferred number of upward pressure resisting buttons is in the range of 2 to 5 buttons per square inch of casing ID. This is because the tool will be called on to resist more downward hydraulic force from the fracking operation than upward hydraulic force from production below the tool. A useful tool may have from four times to one and ½ times more downward pressure resisting buttons than upward pressure resisting buttons.

Turning to FIG. 7, it is seen that sleeve 515 may include multiple upper wall ratchet ribs 554 as part of inner surface 536. FIG. 7 also illustrates that outer surface 534 may have multiple sealing ribs or grooves 522 on the outer surface thereof, such that in a set position (see FIG. 13, for example), the outer surface of the sleeve may more tightly and fluid sealingly engage the casing. There may be a notch 524 to help the sleeve move towards the casing during setting. Sleeve 515 may have an upper end 544 and lower end 546.

FIG. 7A illustrates that embodiment of sleeve 514 may have a smooth or non-ribbed upper/inner inclined wall 540, which may be dimensioned for receipt of ball 521 thereon or the ball may be dimensioned to permit ball 521 to pass there through, so ball 521 may be introduced into the well from the surface and seat within a lower cone 516. With ball 521 seated on either cone, flow is selectively blocked, being prevented from flowing "downhole" past the tool, but not preventing flow "uphole."

FIGS. 8, 9, 9A and 9B illustrate embodiments of sleeve 517, which includes a multiplicity of expansion slots 556, each typically having a channel 558 cut through from the outer to the inner surface (starting at a lower perimeter of the sleeve and extending uphole), as well as an expanded head 556*b* at an uphole end of the slot, and typically terminating before reaching upper/inner inclined wall 540.

FIGS. 8, 9, 9A, and 9B also illustrate that sleeve 517 may have O-ring grooves 558 in addition to or in place of ribs 522, which act to locate O-rings 559 on the outer surface thereof. Expansion of sleeve 517 will press the O-rings against the casing to help fluidly seal the casing plug against the casing. Steel rings bonded with rubber on the outside may be used in place of O-rings for a tight fit into grooves 558.

Figure 12:
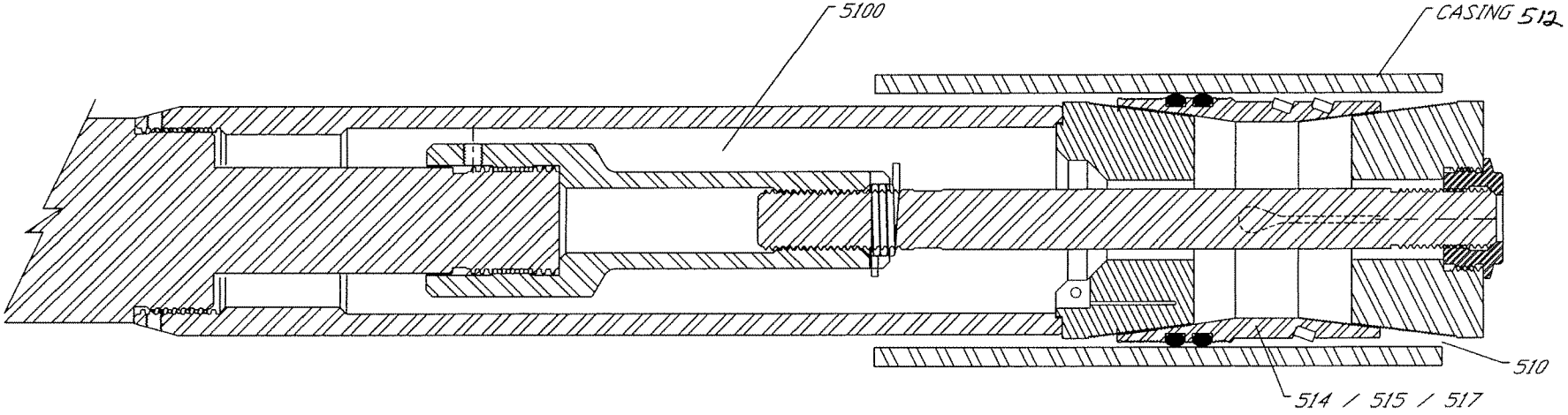
FIG. 12 illustrates in cross-section view, a setting tool for setting Applicant's casing plug, in an unset position.

FIGS. 7, 7A, and 12 illustrate common features to two embodiments of bottom cones 516 (FIG. 7A) and /519 (FIGS. 7 and 12). Bottom cones 516/519 may include an outer surface 560 and an inner surface 562, which inner surface 562 may define a bore having a minimum inner diameter. Outer surface 560 may include inclined a ribbed wall 564 and may also, in some embodiments, include a non-ribbed or smooth wall 566. Inner surface 562 may include threaded walls or shear sub receiving walls 568. Bottom cones 516/519 may have an upper perimeter 570 and a lower perimeter 572, the perimeters usually being generally perpendicular to a longitudinal axis of the cones and connecting outer surface 560 to inner surface 562.

Turning to FIG. 7A, it is seen that bottom cone 519 may include a flapper assembly 574. Flapper valve assembly 574 may also be used on top cone 528. Flapper assembly 574 may selectively block flow through the bore of the sleeve, and may include a flapper valve 576 having a disk-shaped body 575 and a pivot arm 577 extending outward from a perimeter of the disk body. Pivot pin 578 may be provided for engagement with inner surface 562, to allow flapper valve 576 to pivot with respect to bottom cone 519. For acceptance and engagement of flapper valve 574 onto and with bottom cone 519, bottom cone 519 may have its inner surface f configured with pivot arm receiving wall 580 for receipt of pivot arm 577 and for receipt of pivot pin 578. Flapper valve seat 582 may be configured on inner surface 562 for engagement with the perimeter of the disk body when flapper valve 576 is in a closed or flow blocking configuration as seen in FIG. 7. It is to be understood that a greater fluid pressure below casing plug 510 will cause flapper valve 576 to assume an opened position or flow.

Figure 11:
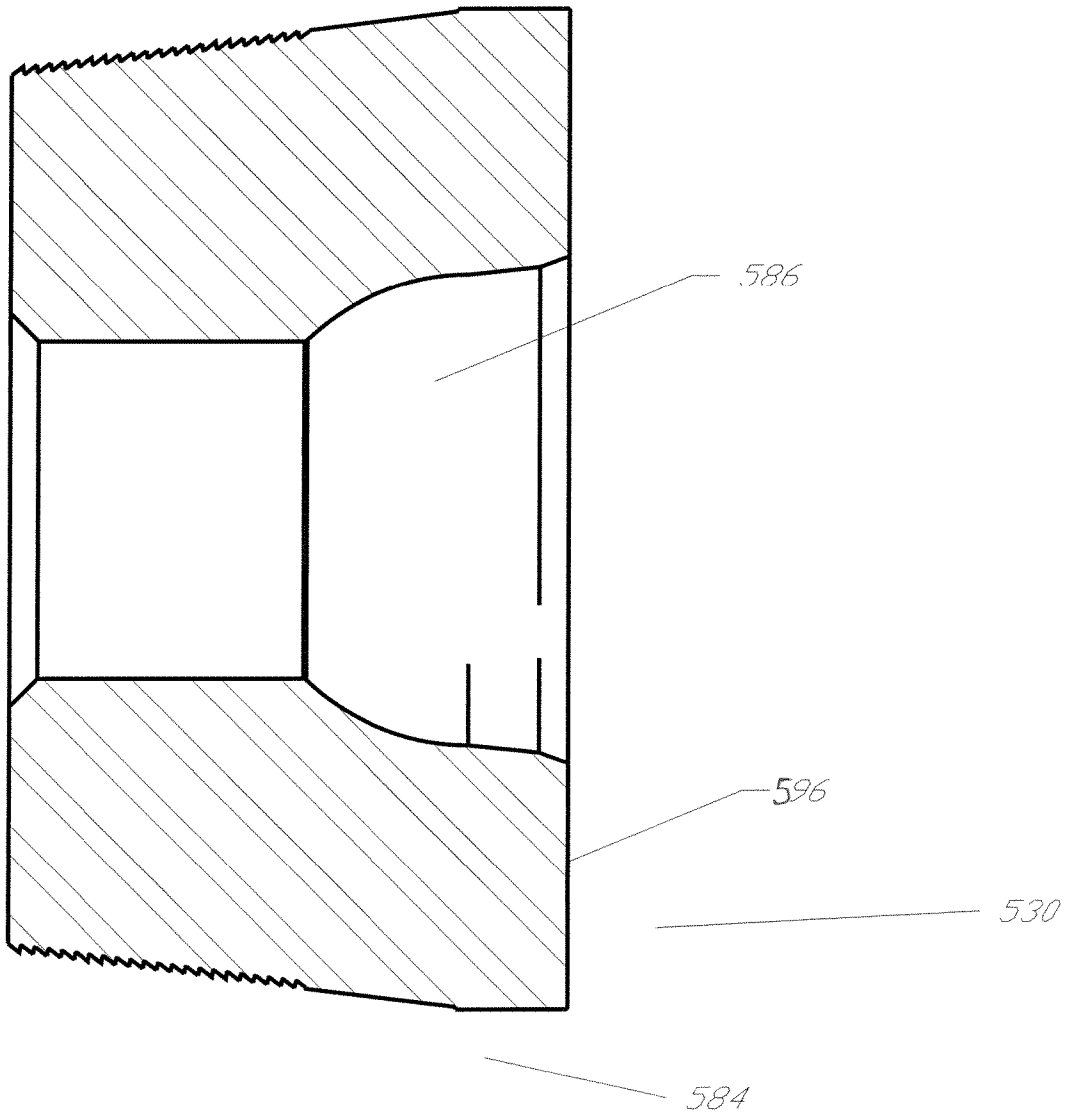
FIG. 11 is a cross-sectional view of another lower cone for use with Applicant's casing plug.

Top cones 528 (see FIGS. 7) and 530 (see FIGS. 8 and 11) have common features, including an outer surface 584 and an inner surface 586. Outer surface 584 may include an inclined, ribbed wall 588 and, optionally, a non-ribbed wall 590. Inner surface 586 may include walls defining a bore 592 with a minimum internal diameter and a wall defining a ball seat 594 for receipt of ball 521, for selectively allowing flow through or preventing flow through the plug. Both cones may also include an upper perimeter 596 and a lower perimeter 598 for connecting the inner and the outer surfaces as seen in FIGS. 7, 8, and 11.

Both top cones 528/530 can assume a flow blocking configuration, if desired, with cone 530 using the ball and seat only and cone 528 using flapper assembly 574 (and a ball seat or the flapper assembly alone) configured substantially the same as that set forth with bottom cone 519 (see FIG. 7A).

Figure 10:
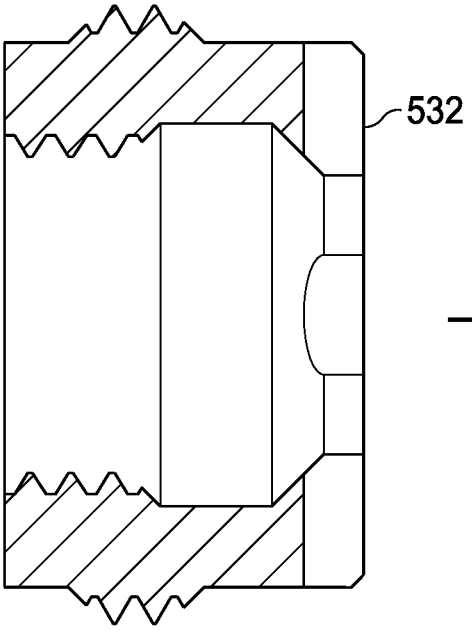
FIG. 10 is an embodiment of a bottom sub or lower cone for use and engagement with a sleeve of Applicant's casing plug.
Figure 10A:
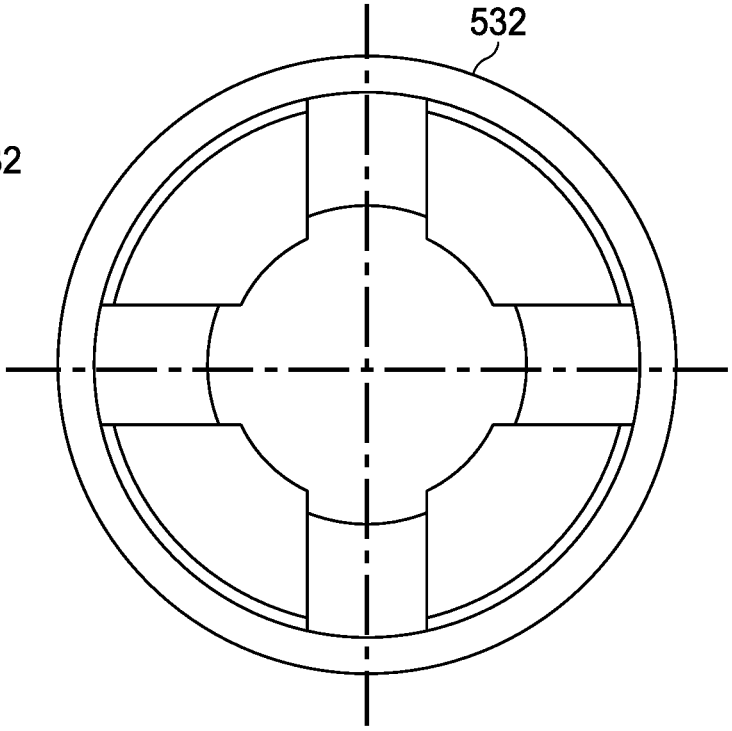
FIGS. 10A and 10B illustrate cross-section and bottom views of a shear sub for use with Applicant's casing plug.
Figure 10B:
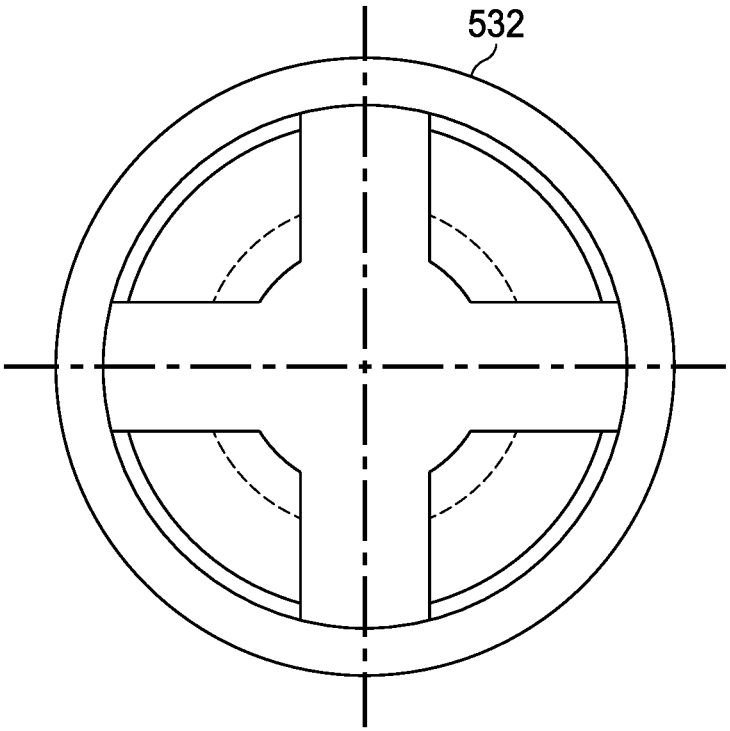

In operation, the plug is run into the well in an unset configuration, in which the outer diameter of the casing patch sleeve with O-rings and/or ribs/buttons (as opposed to the setting sleeve) is less than the inner diameter of the casing. It may be run into the well on any suitable setting tool, for example, an electronic setting tool or on a wireline with an explosive setting tool. When it is run in to a selected depth, typically below a depth that will be perfed and fraced, the plug is set by applying compression between the top cone and bottom cone as seen in FIG. 12. Due to the matching angles of the inclined walls (typically between about 3° and 22° in one range and about 13° to 17° in another) between the tapered sleeve ID and the tapered outer surface OD of the cone or cones, the casing patch sleeve responsive to movement of cone or cones with respect to the sleeve will expand radially outward until the outer surface seals against the inner walls of the casing either through contact with the sleeve's O-rings against the inner walls of the casing or the ribs on the outer surface of the sleeve against the inner walls of the casing (or using both "O" rings and ribs, see FIGS. 12 and 13) or any other conventional manner. At a pressure exceeding the pressure needed to set the plug. Shear sub 532 (see FIGS. 10A and 10B) will shear at shear sub receiving wall 568 releasing the setting tool. The ratchet ribs where the cones meet the inner walls of the sleeve help prevent the cone or cones from "backing out" when the setting compression is released. During setting, sleeve 515 may stretch and thin out, deformation typically exceeding the elastic limit of the sleeve. To assist this deformation, sleeve 515 in some embodiments may be a malleable metal, and about ½" thick at its thickest point (unset). The metal may be dissolvable in downhole fluid.

If the means for selectively blocking fluid flow is a ball, the ball can be run in at this time; if it is a flapper valve, the flapper valve will close and maintain uphole pressure for conventional fracing. In an embodiment, expansion slots 556 (see FIGS. 8 and 9, for example) in the sleeve decrease the force needed to expand the sleeve against the casing and make the expansion more controllable, expansion occurring controllably at predictable places, namely at the slots, by the slots widening. Without the slots, expansion would occur by breaking the sleeve uncontrollably at unpredictable places and with unpredictable geometries. To help expansion, the sleeve may be configured from the following compositions: aluminum, magnesium or alloys of these or any other suitable metal. The minimum inner diameter of the sleeve may be about 3.7" unset and 4" set for 5½" casing having an inner diameter of about 4.778". For 4, 4½ and 5" casing, the minimum inner diameter of the sleeves may be: about 2.5", about 2.5" to 3.3", and about 2.5" to 3.7". The large minimum inner diameter helps fluid flow through the tool.

All casing plug elements, that is, the sleeve, the bottom cone, and the upper cone may be made of dissolvable materials, such as dissolvable metals or dissolvable non-metals. The dissolvable metals may include a degradable magnesium alloy, such as Tervallox from Terves, Inc. or Solumag from Magnesium—Elektron, which metallic alloys may dissolve in a natural or a manmade (added) downhole fluids. The dissolvable non-metals may include polymers, and may also include polymer acids. Two polymer acids, such as PGA or PLA, may be used (see patent application Ser. No. 13/893,195, incorporated herein by reference. One such polymer acid is Kuredux, a high molecular weight polyglycolic acid polymer that has a high mechanical strength, but will breakdown in warm or hot (typically above about 150° F.) downhole fluids.

The '195 reference discloses compositions that may be used to form a configurable insert (see, for example, paragraphs 42, 43 of the reference). The '201 reference also discloses compositions as well as conditions effecting dissolution of these compositions, in paragraphs 62-68, 76-101. Applicant, without limit, notes that any of the element set forth in this application may be formed from the compositions disclosed in the '201 reference, including without limit, these paragraphs.

This application incorporates by reference U.S. application Ser. No. 54/209,313, US 2015/0285026, published Oct. 8, 2015. The '313 reference discloses certain dissolvable metal alloys and other dissolvable composition which dissolve in downhole fluids, may be used for any of the structural elements of this tool, including without limit the cone or cones and sleeve.

When dissolvable compositions are used to make one or more of the elements of Applicant's plug, they may be used with a dissolvable frac ball 521, such as disclosed in the applications incorporated by reference herein. Thus, the casing plug may be used to isolate a downhole zone without requiring milling out. Any combination of the multiple embodiments sleeves, cones, sealing means, etc. may be used for making plug 510.

FIG. 12 illustrates a setting tool 5100 for use in setting applicants casing plug 510. In this embodiment, the setting tool is a Baker 20, but any suitable setting tool may be used to apply compression between the top cone and the bottom cone to expand the sleeve and set it in a fluid sealing portion against the casing. FIG. 13 illustrates Applicant's casing plug in a set position with ball 521 engaging the top or upper cone 520 a/530 in a flow blocking position. FIG. 13 also illustrates an embodiment wherein the sleeve has both elastomeric seals such as O-rings 559, as well as ribs 522. Any combination of the multiple embodiments shown of sleeves, cones, sealing means, etc. may be used for making casing plug 510.

Figure 14A:
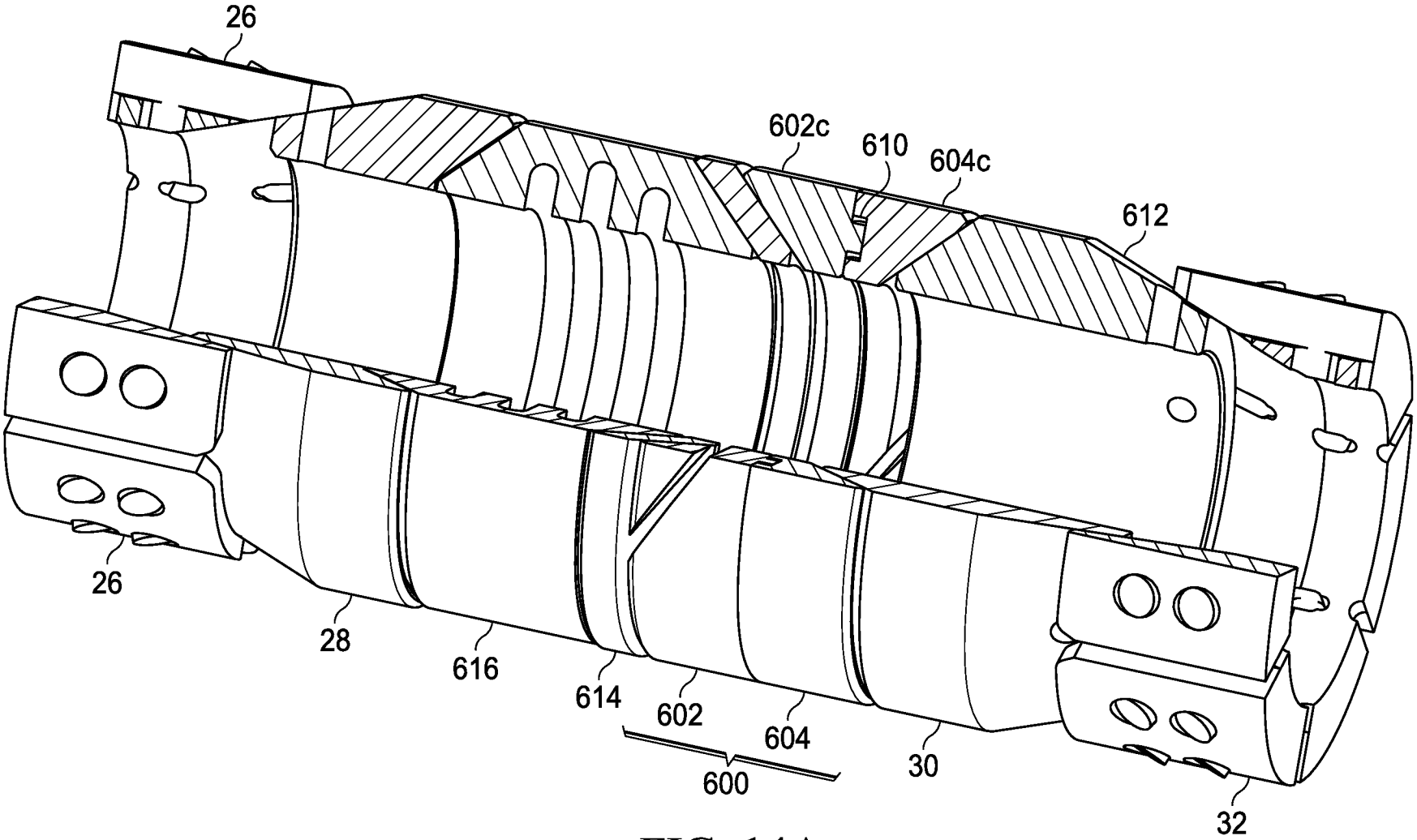
FIGS. 14A, 14B, and 14C are a preset cutaway perspective view, a set quarter cutaway side view, and a set detail cross sectional view of another embodiment of applicant's downhole tool.
Figure 14B:
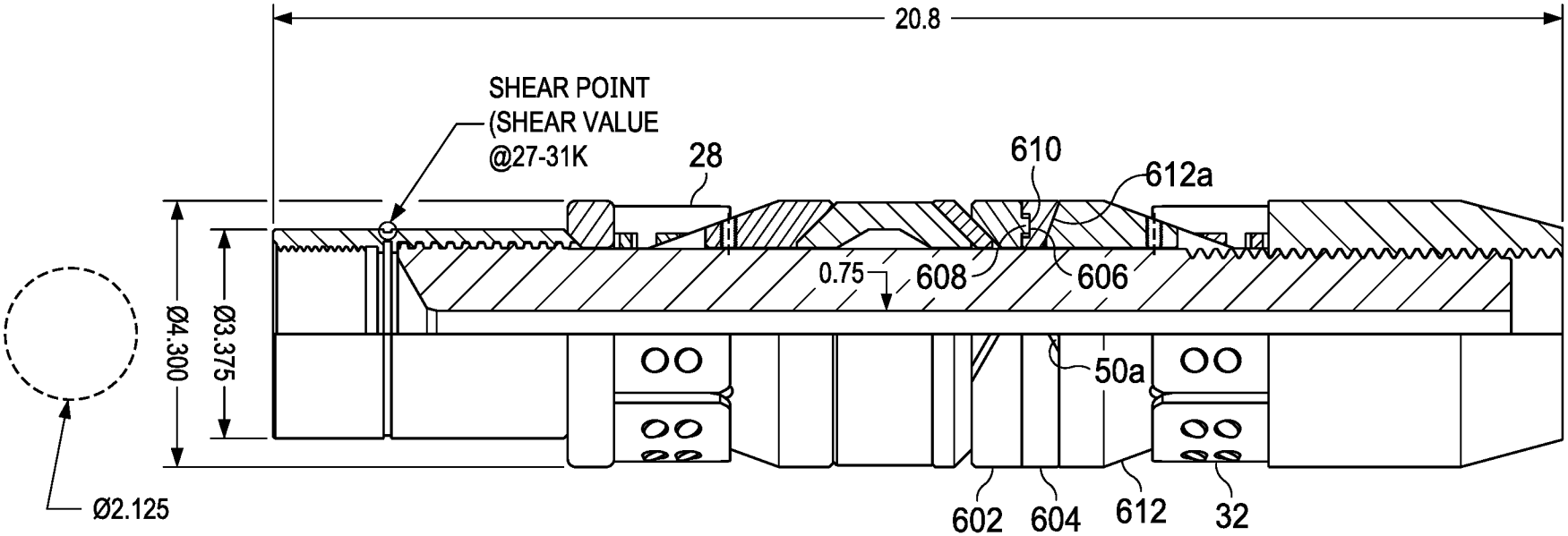
Figure 14C:
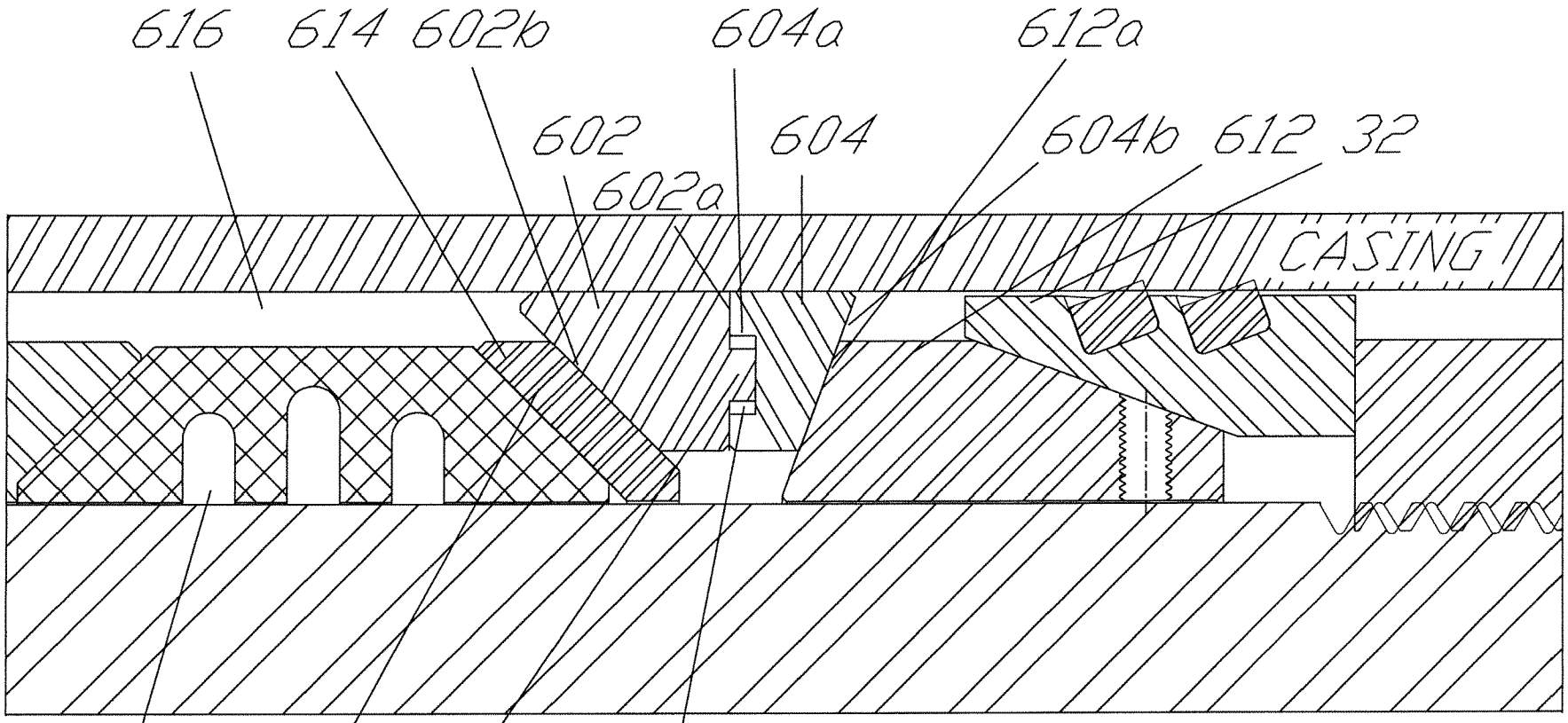

FIGS. 14A, 14B, and 14C illustrate views of another preferred embodiment of applicant's downhole tool having split ring sealing assembly 600 comprised of two split rings 602/604 which rest adjacent to one another with contacting typically flush facing walls, but are interlocked both in preset and set positions here with a tongue (or lip) in groove coupling 606. Moreover, split rings are used with an elastomer, in some embodiments conventional, and others, degradable. Tongue in groove coupling 606 has a tongue 608 on a facing wall of one ring, here split ring 602, engaging a groove 610 on a facing wall of the adjacent ring 604. Such a positive mechanical locking engagement is to be compared to sliding engagement of adjacent surfaces of nesting rings, see FIG. 3 and FIG. 5B for example. These adjacent rings 602/604 may be termed interlocking or positively coupled and it is seen that they have cooperating facing sides for interlocking and each has a side opposite that is inclined and engages a ramping element, here a ramping surface on bottom cone 612, namely, surface 612*a* (see FIG. 14B) and the rear side of an anti-extrusion ring 614. Anti-extrusion ring 614 may be used between split ring assembly 600 and elastomer 616. It is seen in FIG. 14C how the downhole inclined wall 614*a* of ring 614 will act on uphole inclined surface 602*b* of ring 602 to wedge and open ring 602 outward. FIGS. 14A and 14C illustrate the use of multiple elongated cutouts 616*a* on the underside of elastomer 616 (and directed towards the elastomer outer surface) to help it "deform" upward against casing during setting. One (see FIG. 15A) or more slips 28/32 (see FIG. 14A) may be used.

Another feature of the embodiment illustrated in the FIG. 14 series is the use of elastomer 616 configured and made as known in the art with the split rings. FIG. 14C is a detailed review of the plug in a set position showing elastomer 616 deformed and pressed, until sealed against the casing to provide sealing in addition to the sealing provided by split rings 602 and 604. As can be seen in FIG. 14C, mating faces 602*a* and 604*a* have a tongue (or lip) in groove positive mechanical coupling. FIG. 14B shows splits 50*a* to be fully cut all the way through (one full split in split ring 602 and one full split in split ring 604). Splits 50*a* are on a straight but diagonal, here about 60° (range of about) 30°-70° to a longitudinal axis, rather than straight but parallel splits 50 (parallel to the longitudinal axis of the tool) as seen, for example in FIG. 4B. While a straight or split may be used, it is believed that a diagonal split in some embodiments may provide for more effective sealing. An exemplary and non-limiting preset width of the split in the rings may be about 3/32" to about 1/8". When set, about 1/2" to about 3 1/4.

The FIGS. 14A-C and 15 series embodiment is "asymmetrical" or "one sided", meaning the split rings (or a single set or assembly of split rings) are located to one side of an elastomer, rather than on both sides of the elastomer. In some embodiments, the split rings may be on both sides of an elastomer, if one is present. The uphole side is to the left and elastomer 616 is uphole with respect to a two ring split ring assembly 600 in which bottom cone 612 has an uphole angled surface or ramp surface 612*a* to engage a rearward ramp surface or incline 604*b* of ring 604. During setting ramp surface 612*a* of bottom cone 612 radially engages ramp surface or incline 604*b* of bottom split ring 604 to force split ring 604 radially outward. Likewise, a forward incline surface of ring 602 can act on the rearward incline surface of backup or anti-extrusion ring 614. These cooperating inclined surfaces provide for radially outward "wedging" and opening of the rings during setting. The positive coupling provided by the tongue 60 in groove 610 assists if either of the two rings lags behind the other during setting.

Figure 15A:
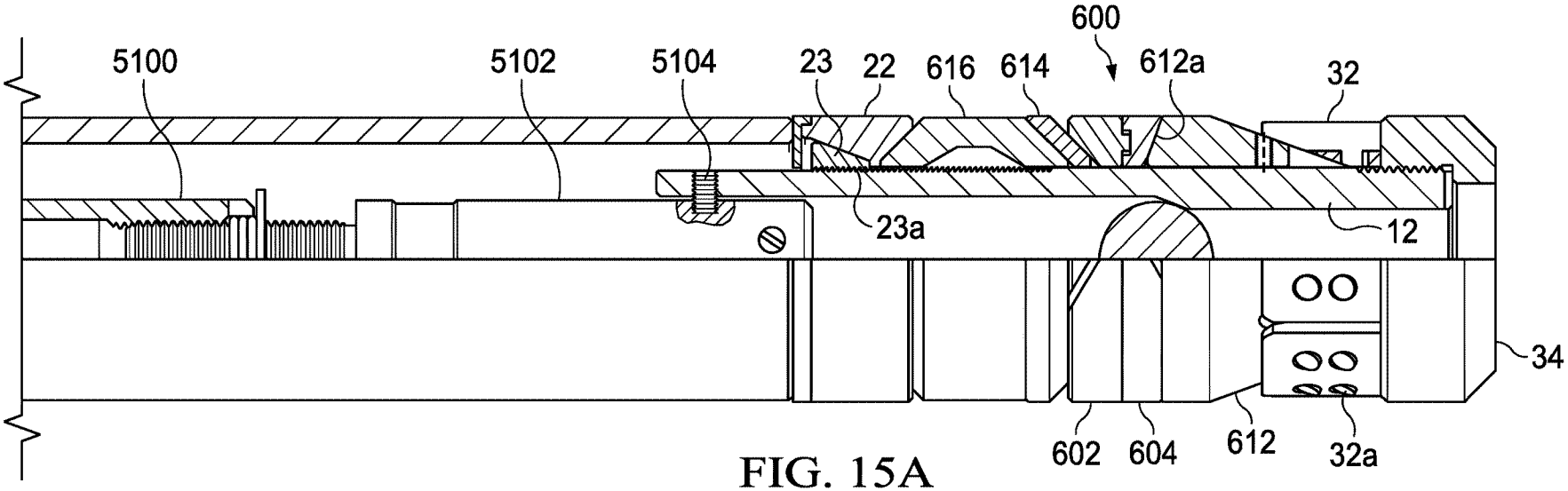
FIGS. 15A (shown as part of a tool), 16A, 16B, 16C, and 16D (apart from the tool) all show views of an interlocking pair of split rings.

In FIG. 15A, the uphole side is to the left of the Figure. In the embodiment of FIG. 15A, only a single slip 28 used and it is located "downhole" of split ring assembly 600, which has elastomer 616 uphole of it. Between the split ring assembly 600 and elastomer 616 may be a backup ring 614. The tool may be run in with a setting tool 5100, which may include an adaptor holster 5102, which may engage the upper end of the tool with shear screws 5104. Mandrel 12 may include a bottom sub 34 or bottom shoe 34. Slip 28 may include buttons, such as cast iron buttons. In both FIGS. 14A and 15A, the cone has inclined or ramp surfaces 612 a inclined in a first direction with regard to a longitudinal axis and a second inclined surface six 112 B, opposite to the first, but both to ramp or a force of their contacting surfaces (split ring and slip) outward during setting.

One, some or all elements of the tools illustrated herein, including the 14 series of Figures and the 15 series of Figures, may be made of any type of dissolvable material. In one embodiment, split rings 602/604 are magnesium, bottom cone 612 is magnesium, backup ring 614 is magnesium, and elastomer 616 may be dissolvable rubber. The magnesium may be a degradable alloy. The degradable elements may be made from materials, including degradable magnesium alloy and degradable rubber, that degrades at temperatures lower than about 200° F. or, in some embodiments, lower than about 160° F. One test at 120° F., 1% saline solution showed sufficient degradation of the entire tool to compete degradation in about 8½ days. At 160°, sufficient degradation occurred in about 5½ days. Mandrel 12 and/or bottom sub 34 may be dissolvable, and made of PGA, PLA or any other acid polymer, as well as any other material degradable in a downhole fluid. Split rings 602/604 may be made from degradable magnesium or other metal, which degrades and is malleable and, thus in setting, may deform somewhat at faces 602*c*/604*c* (see FIG. 14A) and then degrades to release the plug from the casing.

In this embodiment, slip ring bodies 26/32 may be comprised of a dissolvable magnesium or aluminum alloy as set forth herein, while the buttons may be hard iron (harder than the casing). The cones may be made from a degradable metallic or a degradable non-metallic, such as a polymer acid, PGA or PLA as set forth herein. The mandrel may be a dissolvable polymer acid or dissolvable metallic alloy as set forth herein; likewise, the load ring. Elastomer 616 may be a degradable elastomer rubber or elastomer plastic. Thus, all the elements of the downhole tool, or some of the elements of the downhole tool, may be made from dissolvable or degradable material.

In the embodiment of FIG. 15A, the tool includes load ring 22 and a load ring lock-in ring 23 that has a ratcheted surface 23*a*, which ratcheted surface engages the ratcheted exterior surface of the mandrel to help prevent back out when the plug is in a set position. After the tool is set, there may be some rebound force or a force trying to expand the plug back out towards the preset position, and the tilt of buttons 32*a* on lower slip 32 (note tilt downward and uphole of the buttons in the slip to allow the slip to move upward when in contact with the casing during setting, but helping to prevent back out) will also help provide a force in opposition.

Figure 16A:
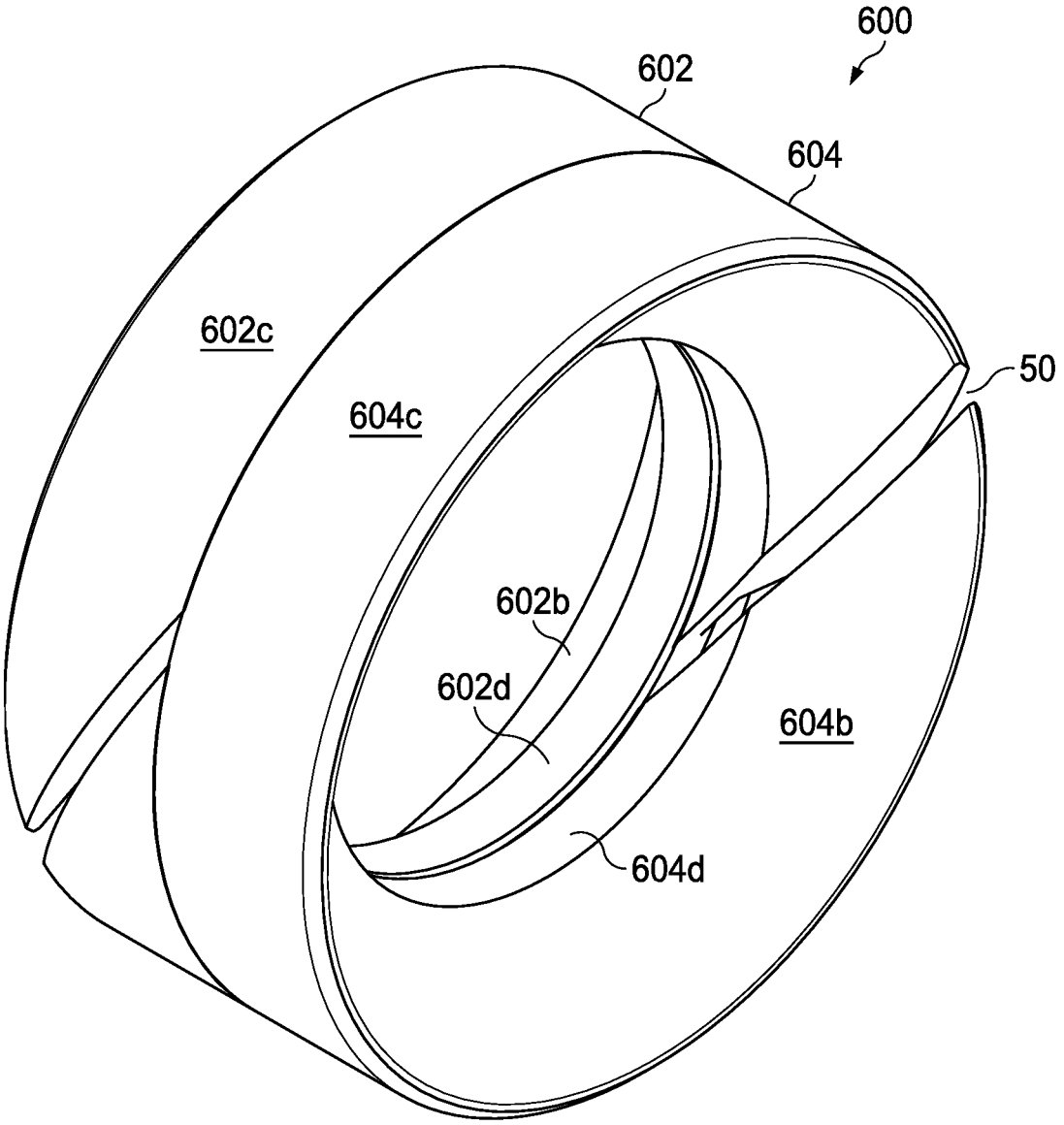
Figure 16B:
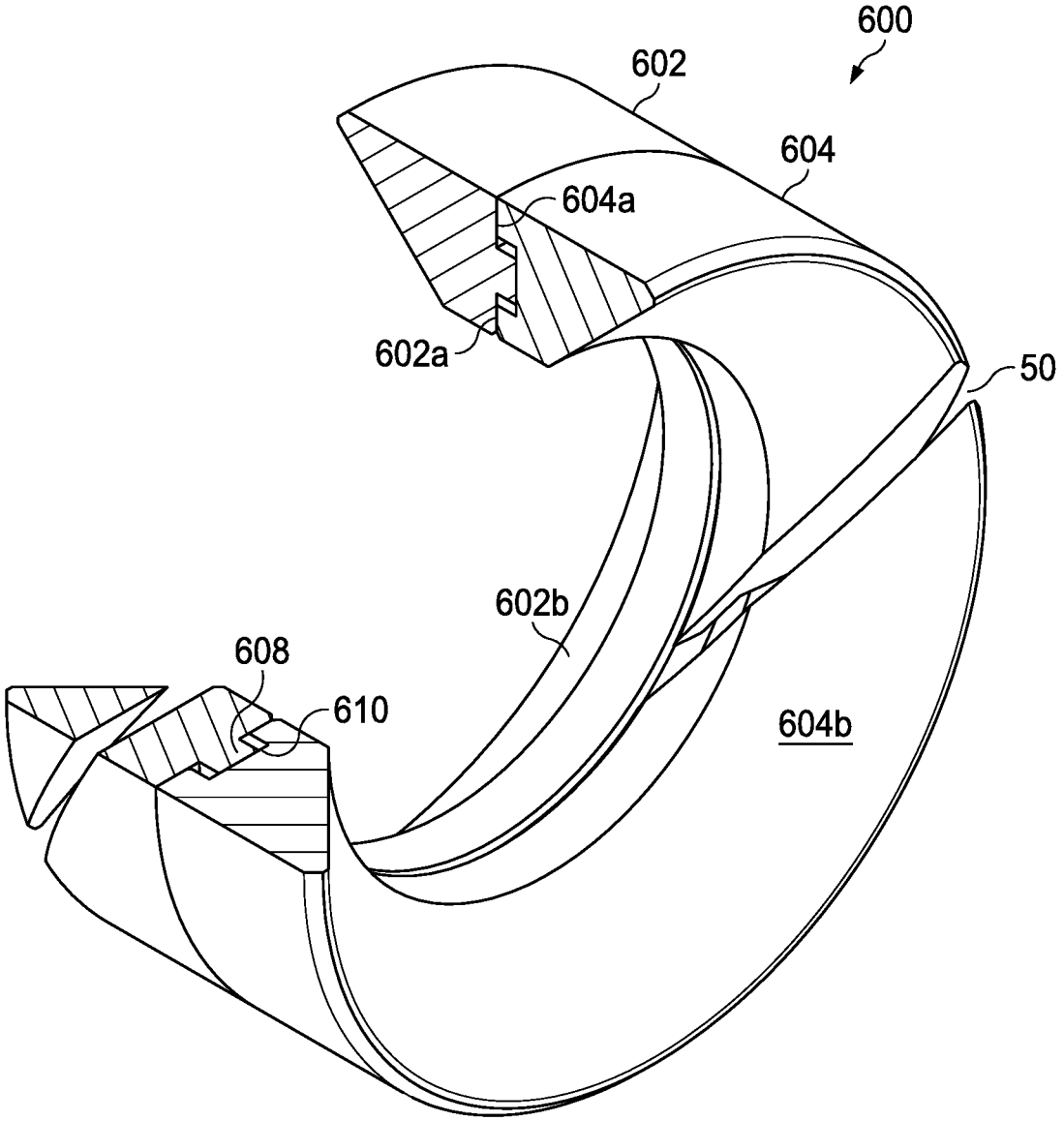
Figure 16C:
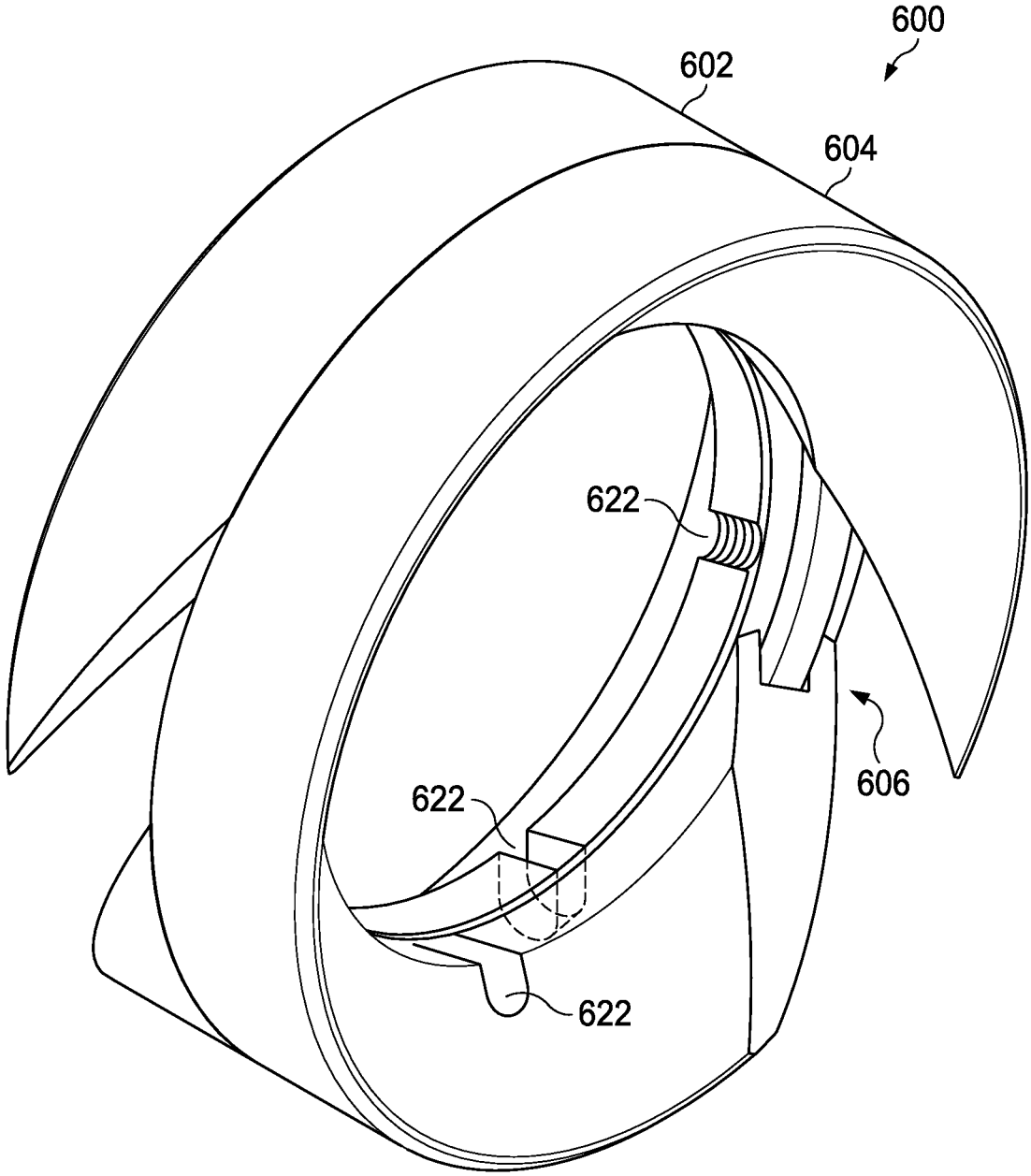
Figure 16D:
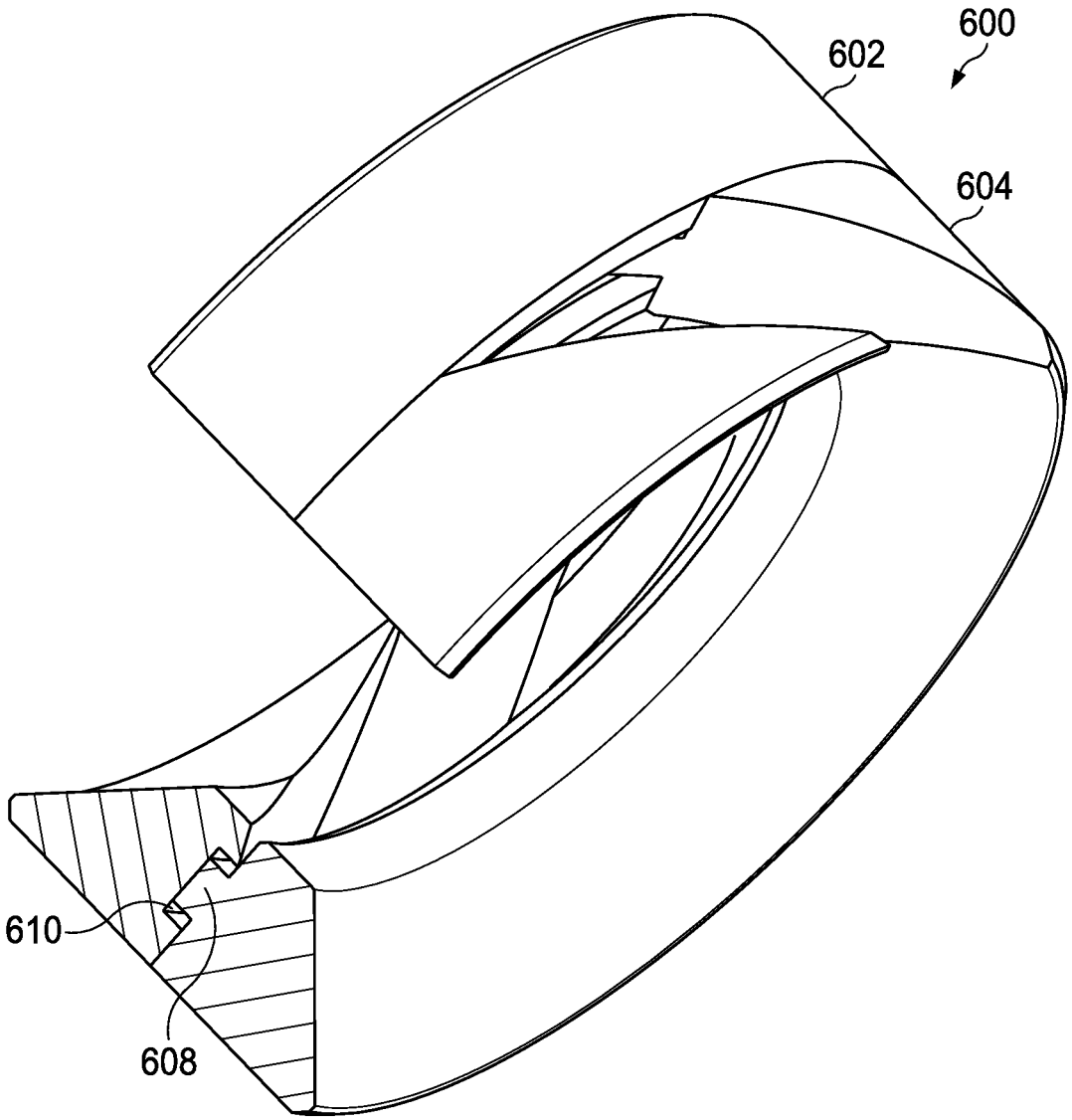

FIGS. 16A, 16B, 16C, and 16D illustrate views of split ring assembly 600 comprising interlocking rings 602/604. It is seen that the rings include the following: mating or facing walls 602*a*/604*a*, ramp or inclined surfaces 602*b*/604*b*, outer faces 602*c*/604*c*, and cylindrical inner faces or surfaces 602*d*/604*d* (FIGS. 16A and 16B, unset; FIGS. 16C and 16D, set). Outer faces may be "wide" in some embodiments for example, greater than about ¼ inch. Each has a single split 50, which may be diagonal (or straight or any other configuration) and extend fully through the ring. Tongue in groove coupling 606 is shown comprising tongue 608 and groove 610. In one embodiment, the inner diameter of the ring across inner surfaces 602*d*/604*d* is just slightly larger than the OD of the mandrel so it easily or snugly slides onto the mandrel. In a second embodiment, the ID of the split rings is larger by about 1/32" to about ¼" larger than the outer diameter of the mandrel, to make it easier to achieve expansion upon setting. One or more webs or slots 622 are seen in FIG. 16C, that may assist in expansion and setting of split rings 602/604 without cracking or breaking the ring during setting. The range of cut angles in a ring may vary from 30° to 80° from the axial direction.

Figure 17A:
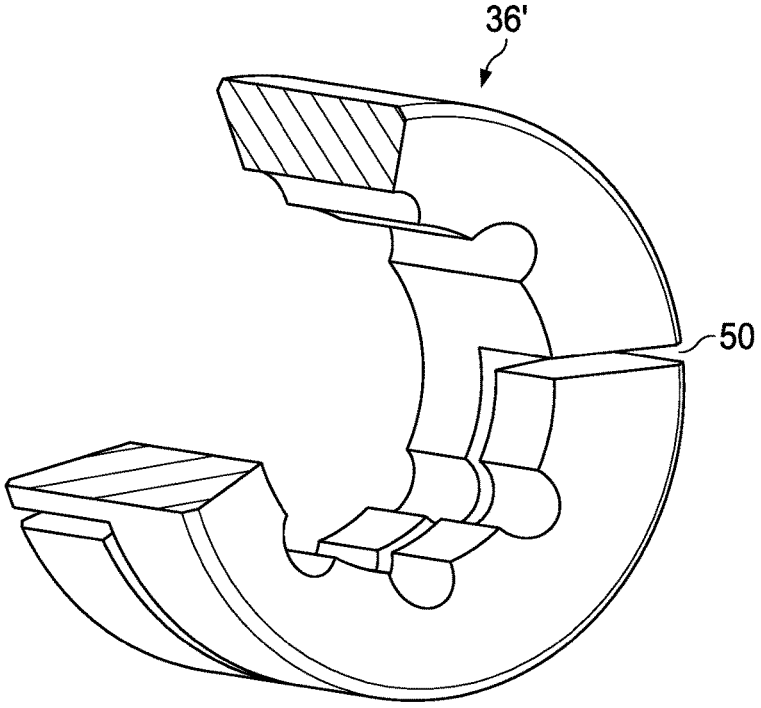
FIGS. 17A, 17B, 17C, and 17D are all views of additional embodiments of Applicant's split rings.
Figure 17B:
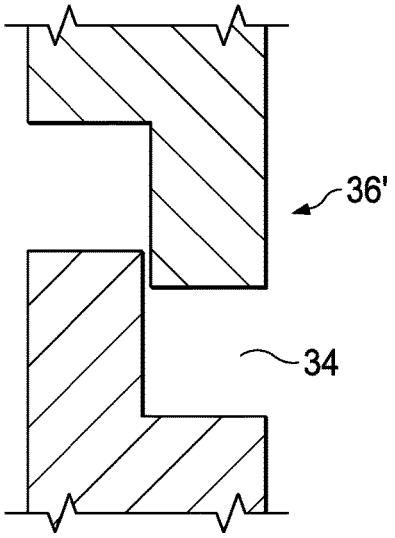
Figure 17C:
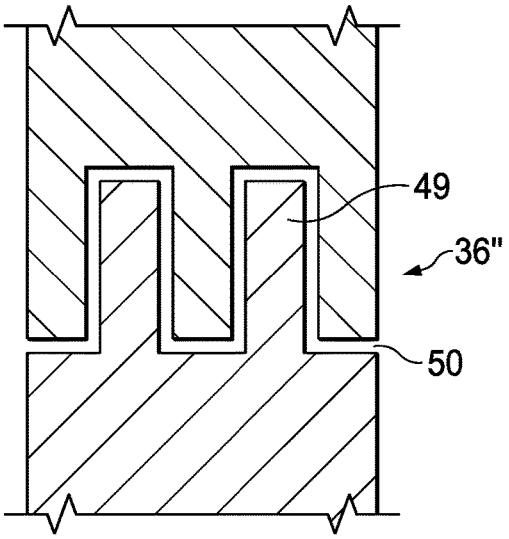
Figure 17D:
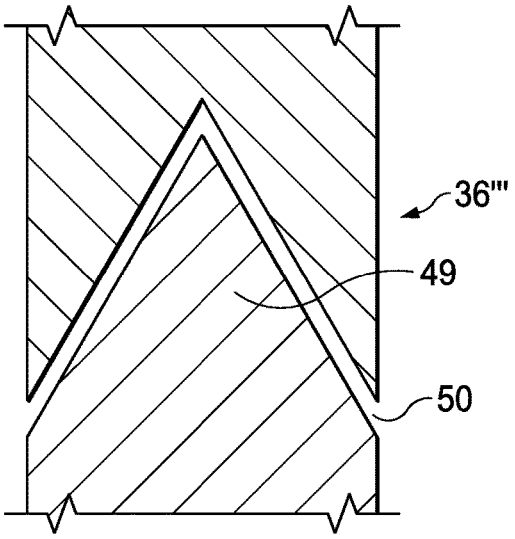

Some of the foregoing illustrations show split ring assemblies comprising one or more split rings, nested or interlocking, for example. FIG. 17A illustrates a single split ring that is not part of an assembly and engages a mandrel without any other split rings. FIG. 17A illustrates single split ring 36' and FIG. 17B illustrates the same single split ring 36' in an expanded (set) position. It is noted that in the expanded position, there is still overlap, as best seen in FIG. 17B, between the cut portions. The manner in which single split ring 36' operates to expand is its uphole and downhole side wall surfaces are inclined inward as best seen in FIG. 17A. Elements of the tool, such as cones, wedges or anti-extrusion rings, may operate on the opposite inclined side wall surfaces of the single split ring 36' to wedge the split open as seen in FIG. 17B, during setting. FIGS. 17C and 17D are embodiments of cuts that may be found in any split ring, single, interlocking or nesting. FIG. 17C shows split ring 36" having two fingers 49 and FIG. 17D shows split ring 36'" having a single finger 49.

In some embodiments the tool may have a first ring having a first circumferential structure protruding from a first gap end of the first ring gap and a first circumferential area recessed in the second gap end of the first ring gap, and the first protruding structure and first recessed area are approximately the same shape; in the first ring's preset configuration, the first ring's first protruding structure is at least partially within the first ring's first recessed area; and during setting of the tool circumferential expansion of the first ring at least partially withdraws the first ring's protruding structure from the first ring's recessed area.

In some embodiments the tool may have a first ring having a first circumferential finger protruding from a first gap end of the first ring gap and a first circumferential slot recessed in the second gap end of the first ring gap, and the first finger and first slot are approximately the same shape; in the first ring's preset configuration, the first ring's first finger is at least partially within the first ring's first slot; and during setting of the tool circumferential expansion of the first ring at least partially withdraws the first ring's finger from the first ring's slot. The tool may have the first ring having a first circumferential finger protruding from a first gap end of the first ring gap and a first circumferential slot recessed in the second gap end of the first ring gap, and the first finger and first slot are approximately the same shape; in the first ring's preset configuration, the first ring's first finger is at least partially within the first ring's first slot; the second ring having a first circumferential finger protruding from a first gap end of the second ring gap and a first circumferential slot recessed in the second gap end of the second ring gap, and the first ring's first finger and first slot are approximately the same shape; and in the second ring's preset configuration, the first ring's second finger is at least partially within the first ring's first slot. A single ring may have multiple fingers and slots. Ring width may range from ⅛ inch to 3 inches, the width varying by how many split rings are used and their O. D.s relative to the casing's I. D.

The ring's fingers and slots may be substantially rectangular, triangular or curved. A "Z" ring gap has a upper finger from the upper ring which is about half the width of the rings with ring and a lower finger from the lower ring which is about half the width of the lower rings width, the mirror image fingers overlapping each other without an exterior side holding either finger. A diagonal cut of the ring to create the gap produces a ring with a diagonal gap, i.e. the gap having a diagonal angle relative to the playing of the ring. Such a diagonal cut or a "Z" ring gap or a ring finger fitting within an adjacent ring slot, serves similar functions of allowing the ring to expand at the gap without leaving the gap open to unrestricted fluid flow through the gap. Axial compression of the ring during setting of the tool helps seal a gap having any of these structures. This provides overlapping fingers with maximum width. The fingers may be circumferentially longer than axially wide and setting the tool may not completely withdraw the finger from the slot. The fingers may be any length long enough to maintain a finger/slot overlap of about quarter inch to ½ inch after setting. The fingers may preferably be from about ½ inch to about 1½ inches long, more preferably from 1/16 inch to 1 inch long, and preferably from about 1/16 inch to about 1½ inch wide, more preferably from ⅛ inch to 1 inch wide.

Any of the sealing element/split ring structures may be used as the body of a slip holding inserts. For example, the described split ring structures may be used as a slip body structure and inserts or buttons embedded on their outer surface to produce a slip for holding the tool to the casing. Likewise, any of the described split ring materials may be used for a slip body material.

A downhole tool seal is typically made of an elastomer. Because the elastomer's solvents that make it flexible are aromatic they evaporate over time. Solvent evaporation makes the elastomer less ductile, i.e. hard, so it takes more force to press a solvent depleted elastomer against the casing and its seal with the casing is less effective. A prior art approach to addressing this problem is to spray elastomer with the solvent during tool assembly so some of the solvent will leach into the bulk of the elastomer. Unfortunately, sometimes a sprain solid on the surface of an elastomer gets too much solvent into the surface area of the elastomer, making it to soft or gummy, and is not get enough additional rejuvenator solvent into the interior of the elastomer, leaving it hard. An elastomer which is unknowably possibly too soft in some portions due to too much additional solvent and too hard in other portions due to not enough additional solvent is not ideal. Prior art elastomers have sometimes used a single triangular shaped cut out on the bottom/mandrel facing side of the elastomer, in part to get more of the elastomer's inner bulk more evenly distributed relative to the elastomer's surface.

Use of long cavities or cutouts 616*a* (see FIG. 14C) on the underside of the seal permits getting more solvent/rejuvenator into more of the elastomer's bulk more quickly and more evenly than a single triangular-shaped cavity. Several long mandrel facing radial cavities get more of the elastomer's bulk closer to the elastomer's surface when it is sprayed/dunked with solvent. This is believed to lessen the problem of putting so much solvent on the surface of the traditionally shaped elastomer that the outer surface layers of the elastomer absorb too much elastomer and become mushy while the inner core of the elastomer that has received little or no solvent is still hard.

Additionally, it is believed this geometry provides some benefit during setting, axial compression of a seal with the radial spaces as shown causing the elastomeric seal to radially press outward into a better sealing engagement with the casing.

The present invention is adapted to attain the ends and advantages mentioned as well as those that are inherent therein. The embodiments disclosed above are illustrative only, as the present invention may be modified and practiced in different but equivalent manners apparent to those skilled in the art having the benefit of the teachings herein. No limitations are intended to limit the details of construction or design shown, other than as described in the claims below. The illustrative embodiments disclosed above may be altered or modified and all such variations are considered within the scope and spirit of the present invention.

The terminology used herein is for the purpose of describing particular implementations only and is not intended to be limiting. The singular form "a", "an", and "the" are intended to include the plural forms as well, unless the context clearly indicates otherwise. The terms "comprises" and/or "comprising," when used in the this specification, specify the presence of stated features, integers, steps, operations, elements, and/or components, but do not preclude the presence or addition of one or more other features, integers, steps, operations, elements, components, and/or groups therefore. Compositions and methods described in terms of "comprising," "containing," or "including" various components or steps, can also "consist essentially of or "consist of the various components and steps.

Whenever a numerical range with a lower limit and an upper limit is disclosed, any number and any included range falling within the range is specifically disclosed. Every range of values (of the form, "from about a to about b," or, equivalently, "from approximately a to b," or, equivalently, "from approximately a to b") disclosed herein is to be understood to set forth every number and range encompassed within the broader range of values. The terms in the claims have their plain, ordinary meaning unless otherwise explicitly and clearly defined by the patentee. If there is any conflict in the usages of a word or term in this specification and one or more patent(s) or other documents that may be incorporated herein by reference, the definitions that are consistent with this specification should be adopted.

The corresponding structure, materials, acts, and equivalents of all means or steps plus function elements in the claims below are intended to include any structure, material, or act for performing the function in combination with other claimed elements as specifically claimed. The description is presented for the purposes of illustration and description, but is not intended to be exhaustive or limited to the implementations in the form disclosed. Many modifications and variations will be apparent to those of ordinary skill in the art without departing from the scope and spirit of the disclosure. The implementations were chosen and described in order to explain the principles of the disclosure and the practical application and to enable others or ordinary skill in the art to understand the disclosure for various implementations with various modifications as are suited to the particular use contemplated. Those skilled in the art will readily recognize that a variety of additions, deletions, modifications, and substitutions may be made to these implementations. Thus, the scope of the protected subject matter should be judged based on the following claims, which may capture one or more concepts of one or more implementations.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A settable downhole tool for isolating zones in a cased well, the tool comprising:

a mandrel;

a sealing element located about the mandrel for impeding fluid flow between the tool and the casing when the tool is set in the cased well, comprising metallic sealing ring having an inner surface and an outer surface;

the ring has a preset configuration in which the ring's outer surface does not obstruct movement of the tool in the well;

the preset ring has a ring gap entirely through or only partly through the ring between the ring's outer surface and the ring's inner surface;

the ring's outer surface has an outer face for post-set engagement with the casing and the ring outer face has an axial width of at least ¼ inches;

the tool is configured setting the tool in the well radially expands the ring, the radial expansion of the ring circumferentially widens the ring at the ring gap and radially presses the ring outer face into engagement with the casing, and the circumferential widening of the ring at the ring gap moves a portion of the ring inner surface circumferentially relative to the mandrel; and the tool is configured so the post-set ring has an at least substantially fluid tight seal with the casing, so the post-set tool isolates a first zone in the well above the tool from a second zone in the well below the tool to permit fracing the first zone in isolation from the second zone.

2. The tool of claim 1, wherein the sealing element comprises two metallic sealing rings, comprising:

a first metallic sealing ring located about the mandrel, comprising:

a first ring inner surface and a first ring outer surface;

the first ring has a preset configuration in which the first ring outer surface does not obstruct movement of the tool in the well;

the first ring has a first ring gap entirely through or only partly through the first ring between the first ring outer surface and the first ring inner surface;

the first ring has a first ring outer face on the first ring outer surface and the first ring outer face has an axial width of at least about ¼ inches;

a second metallic sealing ring located about the mandrel, comprising:

a second ring inner surface and a second ring outer surface;

the second ring has a preset configuration in which the second ring's outer surface does not obstruct movement of the tool in the well;

the second ring has a second ring gap entirely through or only partly through the second ring between the second ring outer surface and the second ring inner surface;

the second ring has a second ring outer face on the second ring outer surface and the second ring outer face has an axial width of at least ¼ inches;

the first ring gap is not adjacent the second ring gap;

the tool is configured so setting the tool in the well radially expands the first and second rings, the radial expansion of the first and second rings circumferentially widens the first ring at the first ring gap and circumferentially widens the second ring at the second ring gap and radially presses the first ring and second ring outer faces into engagement with the casing, the circumferential widening of the first ring circumferentially relative to the mandrel and relative to the second ring, and the circumferential widening of the second ring moves a portion of the second ring circumferentially relative to the mandrel and relative to the first ring; and the tool is configured so the post-set tool has an at least substantially fluid tight seal with the casing, so the post-set tool isolates zones in the well to permit fracing a first zone above the tool in isolation from a second zone below the tool.

3. The tool of claim 2, wherein the sealing element comprises at least three metallic sealing rings located about the mandrel, comprising:

a third metallic sealing ring, comprising:

a third ring inner surface and a third ring outer surface;

the third ring has a preset configuration in which the third ring's outer surface does not obstruct movement of the tool in the well;

the third ring has a third ring gap entirely through or only partly through the third ring between the third ring's outer surface and the third ring's inner surface;

the third ring has a third ring outer face on the third ring's outer surface which third ring outer face has an axial width of at least ¼ inches;

the first ring gap is not adjacent the second ring gap and the second ring gap is not adjacent the third ring gap;

the tool is configured so setting the tool in the well radially expands the first, second and third rings, the radial expansion of the first, second and third rings circumferentially widens the first ring gap, the radial expansion of the second ring circumferentially widens the second ring gap and the radial expansion of the third ring circumferentially widens the third ring at the third ring gap and radially presses the first, second and third rings' outer faces into engagement with the casing, the circumferential widening of the first, second and third ring gaps moves a portion of the inner surface of the first ring relative to the mandrel and relative to the second ring, moves a portion of the inner surface of the second ring relative to the mandrel, the first ring and the third ring, and moves a portion of the inner surface of the third ring relative to the mandrel and the second ring; and the tool is configured so the post-set tool configuration has an at least substantially fluid tight seal with the casing, so the post-set tool isolates zones in the well to permit fracing a first zone above the tool in isolation from a second zone below the tool.

4. The tool of claims 3, wherein the expanded sealing element's engagement with the casing creates an at least substantially fluid tight metal to metal seal between the sealing element and the casing.

5. The tool of claim 3, further comprising:

a cone located about the mandrel and above the first ring, the cone having a downward face;

the first ring has a downward face and the second ring has an upward face, the cone's downward face and the first ring's upward face are located and are correspondingly angled so setting the tool pushes an upper end of the first ring over a lower end of the cone and radially outward toward the casing;

the first ring has a downward face and the second ring has an upward face, the first ring's downward face and the second ring's upward face are located and are correspondingly angled so pushing the first ring radially outward during setting of the tool pushes the second ring's upward face to push the second ring radially outward toward the casing;

the cone, the first ring and the second ring are located and configured so during setting of the tool the first and second rings are radially expanded against the casing to create an at least substantially fluid tight seal between the tool and the casing, so the tool isolates zones in the well to permit fracing a first zone in isolation from a second zone.

6. The downhole tool of claim 3, wherein all of the sealing element's metallic sealing rings for sealing the tool against the casing are located about the mandrel and below an elastomeric sealing element.

7. The tool of claim 2, wherein the first ring and second ring outer faces each has an axial width of at least ½ inch.

8. The tool of claim 2, wherein the first ring gap is not adjacent the second ring gap, the first ring gap and the second ring gap are at least 30° apart, a solid portion of the first ring overlaps the second ring gap, and a solid portion of the second ring overlaps the first ring gap.

9. The tool of claim 2, further comprising the first ring having a first circumferential tongue or groove on a lower side, and the second ring having a first circumferential groove or tongue on an upper side, the first ring's tongue and second rings' tongue groove being a corresponding combination, being located, shaped and sized so a tongue of one ring fits within a groove of the other ring.

10. The tool of claim 2, further comprising the first ring having a first radial tongue or groove on a lower side and the second ring having a first radial groove or tongue on an upper side, the first ring's tongue and second rings' groove being a corresponding combination, being located, shaped and sized so a tongue of one ring fits within a groove of the other ring.

11. The tool of claim 2, wherein the rings are configured and comprised to dissolve quickly enough in natural aqueous downhole fluid in the well having a pH less than 7 so within less than five days after the tool is immersed in the well's wellbore fluid, the rings are sufficiently dissolved so the tool ceases to isolate a zone above the tool from a zone below the tool, and the rings are sufficiently dissolved so the rings do not prevent beginning production of the well below the tool without milling out the tool, retrieval of the tool from the well, or other intervention on the tool from the surface.

12. The tool of claim 11, wherein the rings are comprised of dissolvable aluminum or magnesium that will dissolve in natural aqueous downhole fluid in the well having a pH less than about 7.

13. The tool of claim 11, wherein the elastomeric sealing element is degradable and is configured and comprised to dissolve quickly enough in natural aqueous downhole fluid in the well having a pH less than 7 so within less than five days after the tool is immersed in the well's wellbore fluid, the tool ceases to isolate the upper zone from the lower zone and permits further completion of the well below where the plug was set in the well or production from the well below where the plug was set in the well, without requiring milling out the tool, retrieval of the tool from the well or other intervention on the tool from the surface.

14. The tool of claim 2, further comprising:

a cone located about the mandrel and above the first ring;

the cone has an outward downward face, and the first ring has a downward face and the second ring has an upward face, the cone's downward face and the first ring's upward face are located and are correspondingly angled so setting the tool pushes an upper end of the first ring over a lower end of the cone and radially outward toward the casing;

the first ring has a downward face and the second ring has an upward face, the first ring's downward face and the second ring's upward face are located and are correspondingly angled so pushing the first ring radially outward during setting of the tool pushes the second ring's upward face to push the second ring radially outward toward the casing;

the second ring has a downward face and the third ring has an upward face, the second ring's downward face and the third ring's upward face are located and are correspondingly angled so pushing the second ring radially outward during setting of the tool pushes the third ring's upward face to push the third ring radially outward toward the casing;

the cone, the first, and second, and third rings are located and configured so during setting of the tool the first, second, and third rings are radially expanded against the casing to create an at least substantially fluid tight seal between the tool and the casing, so the tool isolates zones in the well to permit fracing a first zone in isolation from a second zone.

15. The tool of claim 14 wherein the second ring has a drive shoulder and the first ring has a driven shoulder, and during setting of the tool, the second ring's drive shoulder drives the first ring's driven shoulder to push the first ring over the cone and radially outward to press the first ring's outer face against the casing.

16. The tool of claim 15 further comprising the second ring having a downward face and the third ring having an upward face, the second ring's downward face and the third ring's upward face are not perpendicular to the mandrel and are correspondingly angled so pushing the first ring radially outward during setting of the tool pushes the second ring's upward face to push the second ring radially outward toward the casing;

the cone, the first, second and third rings are located and configured so during setting of the tool the first, second and third rings are radially expanded against the casing to create an at least substantially fluid tight seal between the tool and the casing.

17. The tool of claim 15, wherein, relative to the axis of the mandrel, the angles of the cone's lower face, the upward face of the first ring, the downward face of the first ring and the upward face of the second ring are substantially the same angle and are in the range of 15° to 50°.

18. The tool of claim 15, wherein the lowermost sealing ring about the mandrel has a downward face located, configured and sized relative to the tool's other elements to provide an expansion space outside of the lower ring's downward face, within which expansion space the lower ring may be radially expanded outward when, during setting of the tool, the upper end of the lower ring is pushed over the lower end of the next higher ring and radially outward toward the casing.

19. The tool of claim 1, wherein the first ring has a gap cut entirely through the first ring between the ring's outer surface and the first ring's inner surface.

20. The tool of claim 1, wherein the first ring's outer face has an axial width of at least ½ inch.

21. The tool of claim 1, wherein the width of the preset first ring gap is 3/32 inches or more and the width of the post-set first ring gap when set in 5½ inch casing is greater than 1.5 inches.

22. The tool of claim 1, wherein the width of the post-set first ring gap is more than ten times greater than the width of the pre-set first ring gap.

23. The tool of claim 1, wherein at least the first ring gap has a first end and a second end, and the first ring gap is a non-straight gap, and some non-straight portions of the first ring gap's first end and some non-straight portions of the first ring gap's second end reciprocally circumferentially overlap each other, and the tool is configured so setting the tool axially compresses some non-straight portions of the first ring gap's first end and some non-straight portions of the first ring gap's second end non-straight portions together.

24. The tool of claim 1, further comprising:

the first ring gap has a first end and a second end;

the first ring gap first end has a first protrusion circumferentially protruding from the first ring gap first end;

the first ring gap second end has a recess circumferentially recessed in the first ring gap second end;

the first ring gap first end protrusion and the first ring gap second end recess have the same reciprocal size and shape;

in the tool's preset configuration, the first ring gap first end protrusion at least partially circumferentially overlaps the first ring first gap second end recess; and the tool is configured so setting the tool in the cased well will cause an at least partial circumferential withdrawal of the first ring gap first end protrusion from the first ring gap second end recess.

25. The tool of claim 24, wherein the first protrusion is circumferentially longer than the first protrusion is axially wide and the tool is configured so the setting the tool does not completely withdraw the first protrusion from the first ring gap second end recess.

26. The tool of claim 24, wherein the first ring gap's protrusion and recess area define the gap to be diagonal to the plane of the ring.

27. The tool of claim 1, further comprising:

the first ring gap has a first end and a second end;

the first ring gap first end has a finger circumferentially protruding from the first ring gap first end;

the first ring gap second end has a slot circumferentially recessed in the second gap end of the first ring gap second end;

the first ring gap first end finger and the first ring gap second end slot have the same reciprocal size and shape;

in the tool's preset configuration, the first ring gap first end finger is at least partially within the first ring gap second end slot; and the tool is configured so setting the tool in the cased well will cause an at least partial circumferential withdrawal of the first ring gap first end finger from the first ring gap second end slot.

28. The tool of claim 27, wherein the first ring gap first end finger and the first ring gap second end slot are each substantially rectangular.

29. The tool of claim 27, wherein the first and second rings' fingers are each at least ½ inches long.

30. The tool of claim 27, wherein the first and second rings' fingers are each at least ⅛ wide.

31. The tool of claim 30 wherein setting the tool causes the downward face of the cone and the upward face of the first ring to directly engage each other as the first ring is pushed over the cone and radially outward by the cone.

32. The tool of claim 1, comprising: the tool is configured so during setting of the tool in the cased well, the first ring's gap circumferentially widens and a solid non-gap portion of the first ring radially expands into close engagement with the casing without first ring breaking the solid non-gap portion& of the first ring.

33. The tool of claim 1, wherein the first ring gap is not cut entirely through from the first ring's outer surface to the first ring's inner surface.

34. The tool of claim 1, wherein the first ring gap first end and second end have reciprocal faces foward each other which are not tangential to the mandrel.

35. The tool of claim 1, wherein the first ring gap first end and second end have reciprocal faces toward each other which in at least one dimension are not radial to the mandrel, have substantially the same tangential angle, and have a tangential angle of 45° to 70° to the mandrel's axis.

36. The tool of claim 1, wherein the ring is cut only part way through the ring from the ring's outer surface toward the ring's inner surface at multiple locations on the ring, the uncut portions connecting the ring at multiple partial gaps in the ring, and wherein setting the tool breaks multiple uncut portions of the gaps as setting the tool expands the ring radially outward.

37. The tool of claim 1, wherein the ring face is comprised of a metal malleable enough to deform enough against the casing to form a better post-set metal to metal seal with the casing against fluid flow between the tool and the casing when setting the tool presses the ring's face against the casing than a reference ring face, the reference ring face being identical to the ring face except being made of cast iron.

38. The downhole tool of claim 1, wherein the tool is comprised so the substantially fluid tight metal to metal seal between the sealing element and the casing, will be an incomplete seal, permitting some fluid from above the tool to trickle past the tool to below the tool, and particulate matter in the trickling fluid will be caught between the tool and the casing and on top of the tool, to create a tool to casing seal tight enough to enable the zone above the tool to be frac to in isolation from the zone below the tool.

39. The downhole tool of claims 1, wherein the tool does not have an elastomeric sealing element for sealing the tool to the casing.

40. The downhole tool of claims 2, further comprising an elastomeric sealing element located about the mandrel for sealing the tool to the casing with an elastomer to metal casing seal in addition to the metallic sealing ring's metal to metal seal with the casing.

41. A settable downhole tool for isolating zones in a cased well, the tool comprising:

a mandrel;

a sealing element located about the mandrel for impeding fluid flow between the tool and the casing, comprising at least two non-elastomeric sealing rings, a first ring and a second ring;

each first ring and second ring;

has an inner surface facing toward the mandrel and an outer surface facing away from the mandrel;

has a preset configuration in which the ring's outer surface does not obstruct movement of the tool in the well;

has a gap entirely through or only partly through the ring from the ring's outer surface through the ring's inner surface;

has an outer face on the ring's outer surface which outer face has an axial width of at least about ¼ inches;

the first ring has a first circumferential tongue or groove on a lower side, and the second ring has a first circumferential groove or tongue on an upper side, the first and second rings' tongue and groove being a corresponding tongue and groove combination, being located, shaped and sized so a tongue of one ring fits within a groove of the other ring;

the ring faces are malleable enough to deform enough against the casing to form a better seal with the casing when setting the tool presses the ring's face against the casing than a similar ring with a face made of cast iron;

the tool is configured so:

the first ring gap is not adjacent the second ring gap, the ring gaps being at least 30° apart, so in the tool's post-set configuration a solid portion of the first ring overlaps the second ring's gap and a solid portion of the second ring overlaps the first ring's gap, and the overlapping rings impede fluid flow through the sealing element; and setting the tool radially expands the first and second rings to radially press their outer faces into engagement with the casing, the radial expansion of the first ring circumferentially widens the first ring gap and the radial expansion of the second ring circumferentially widens the second ring gap, the widening of the first ring gap slides a portion of the first ring circumferentially relative to the mandrel and the second ring, and the widening of the second ring gap slides a portion of the second ring circumferentially relative to the mandrel and the first ring; and the tool is configured so the post-set tool has an at least substantially fluid tight seal with the casing, so the tool isolates zones in the well and a zone in the well can be fraced in isolation from a zone in the well on the other side of the tool.

42. A settable downhole tool for isolating zones in a cased well, the tool comprising:

a mandrel;

a cone located about the mandrel;

a sealing element located about the mandrel and adjacent the cone for impeding fluid flow between the tool and the casing when the tool is set in the casing, comprising at least two non-elastomeric sealing rings, a first ring and a second ring;

each first ring and second ring;

has an inner surface facing toward the mandrel and an outer surface facing away from the mandrel;

has a preset configuration in which the ring's outer surface does not obstruct movement of the tool in the well;

has a gap entirely through or only partly through the ring from the ring's outer surface through the ring's inner surface;

has an outer face on the ring's outer surface which outer face has an axial width of at least ½ inches; and the first and second ring faces are each malleable enough to deform enough against the casing to form a better post-set seal with the casing when setting the tool than a reference ring face, the reference ring face being identical to the ring face except being made of cast iron presses the ring's face against the casing against fluid flow between the tool and the casing than a reference ring face, the reference ring face being identical to the ring face except being made of cast iron;

the tool is configured so:

the cone has a downward face, and the first ring has a upward face, the cone's downward face and the first ring's upward face are located and are correspondingly angled so setting the tool pushes an upper end of the first ring over a lower end of the cone to push the first ring radially outward toward the casing;

the first ring has a downward face and the second ring has an upward face, the first ring's downward face and the second ring's upward face are located and are correspondingly angled so setting the tool pushes an upper end of the second ring over a lower end of the first ring to push the second ring radially outward toward the casing;

relative to the axis of the mandrel, the angles of the cone's lower face, the upward face of the first ring, the downward face of the first ring and the upward face of the second ring are substantially the same angle and are in the range of 15° to 50°;

the first ring gap is not adjacent the second ring gap, the first and second ring gaps are at least 30° apart, so in the tool's post set configuration a solid portion of the post-set first ring overlaps the second ring's gap and a solid portion of the post-set second ring overlaps the first ring's gap, and the overlapping first and second rings impede fluid flow through the sealing element; and setting the tool expands the first and second rings to radially press their outer faces into engagement with the casing, the radial expansion of the first ring circumferentially widens the first ring gap and the radial expansion of the second ring circumferentially widens the second ring gap, the widening of the first ring gap slides a portion of the first ring circumferentially relative to the mandrel and the second ring, and the widening of the second ring gap slides a portion of the second ring circumferentially relative to the mandrel and the first ring; and the tool is configured so the post-set tool has an at least substantially fluid tight seal with the casing, so the tool isolates zones in the well and a zone in the well on one side of the tool can be fraced in isolation from a zone in the well on the other side of the tool.

43. The tool of claim 42 wherein the rings are configured and comprised to dissolve quickly enough in natural aqueous downhole fluid in the well having a pH less than 7 so within less than five days after the tool is immersed in the well's wellbore fluid, the rings are sufficiently dissolved so the tool ceases to isolate the zones in the well.

44. A settable downhole tool for isolating zones in a cased well, the tool comprising:

a mandrel;

a sealing element located about the mandrel for impeding fluid flow between the tool and the casing when the tool is set in the cased well, comprising a metallic sealing ring having an inner surface and an outer surface;

the ring has a preset configuration in which the ring's outer surface does not obstruct movement of the tool in the well;

the preset ring has a ring gap entirely through or only partly through the ring between the ring's outer surface and the ring's inner surface;

the ring outer surface has an outer face for post-set engagement with the casing and the ring outer face has an axial width of at least one half inches;

the tool is configured so setting the tool in the well radially expands the ring, the radial expansion of the ring circumferentially widens the ring at the ring gap and radially presses the ring outer face into engagement with the casing, and the circumferential widening of the ring at the ring gap moves a portion of the ring inner surface circumferentially relative to the mandrel;

wherein the width of the preset ring gap is 3/32 inches or more and the width of the post-set ring gap when set in 5½ inch casing is greater than 1.5 inches; and the ring face is malleable enough to deform enough against the casing when the tool is set in the casing to form a better post-set seal against fluid flow between the ring face and the casing than a reference ring face, the reference ring face being identical to the ring face except being made of cast iron, and the tool is configured so the post-set ring has an at least substantially fluid tight seal with the casing, so the post-set tool isolates a first zone in the well above the tool from a second zone in the well below the tool to permit fracing the first zone in isolation from the second zone.

45. The tool of claim 44, wherein has a ring gap first end and a ring gap second end and the ring gap first end and the second end have reciprocal faces toward each other, which, in at least one dimension, are not radial to the mandrel, have substantially the same tangential angle relative to the mandrel, have a tangential angle of 45° to 70° to the mandrel's axis and the tool is configured as setting the tool compresses the ring gap first end and the ring gap second end together.

46. The tool of claim 45, wherein the first ring outer face has an axial width of at least one inch.

47. A settable downhole tool for isolating zones in a cased well, the tool comprising:

a mandrel;

a sealing element located about the mandrel for impeding fluid flow between the tool and the casing when the tool is set in the cased well, the sealing element comprising two metallic sealing rings, comprising:

a first metallic sealing ring located about the mandrel, comprising:

a first ring inner surface and a first ring outer surface;

the first ring has a preset configuration in which the first ring outer surface does not obstruct movement of the tool in the well;

the first ring has a first ring gap entirely through or only partly through the first ring between the first ring outer surface and the first ring inner surface;

the first ring has a first ring outer face on the first ring outer surface and the first ring outer face has an axial width of at least ¼ inches;

a second metallic sealing ring located about the mandrel, comprising:

a second ring inner surface and a second ring outer surface;

the second ring has a preset configuration in which the second ring's outer surface does not obstruct movement of the tool in the well;

the second ring has a second ring gap entirely through or only partly through the second ring between the second ring outer surface and the second ring inner surface;

the second ring has a second ring outer face on the second ring outer surface and the second ring outer face has an axial width of at least ¼ inches;

the first ring gap is not adjacent the second ring gap;

a cone located about the mandrel and above the first ring, the cone having a downward face;

the cone, the first ring and the second ring are located and configured so during setting of the tool the cone radially expands the first and second rings, the radial expansion circumferentially widens the first ring at the first ring gap and circumferentially widens the second ring at the second ring gap and radially presses the first ring and second ring outer faces into engagement with the casing, the circumferential widening of the first ring moves a portion of the inner surface the first ring circumferentially relative to the mandrel and relative to the second ring, and the circumferential widening of the second ring moves a portion of the second ring relative to the mandrel and relative to the first ring;

wherein the width of the preset ring gap is 3/32 inches or more and the width of the post- set ring gap when set in 5½ inch casing is greater than 1.5 inches; and the ring face is malleable enough to deform enough against the casing when the tool is set in the casing to form a better post-set seal against fluid flow between the ring face and the casing than a reference ring face, the reference ring face being identical to the ring face except being made of cast iron; and the tool is configured so the post-set ring has an at least substantially fluid tight seal with the casing, so the post-set tool isolates a first zone in the well above the tool from a second zone in the well below the tool to permit fracing the first zone in isolation from the second zone.

48. The tool of claim 47, wherein the first ring outer face and the second ring outer face each has an axial width of at least one inch.

* * * * *